US008775121B2

(12) United States Patent
Klenkler et al.

(10) Patent No.: US 8,775,121 B2
(45) Date of Patent: Jul. 8, 2014

(54) METHODS FOR MEASURING CHARGE TRANSPORT MOLECULE GRADIENT

(75) Inventors: Richard A. Klenkler, Oakville (CA); Gregory McGuire, Oakville (CA)

(73) Assignee: Xerox Corporation, Norwalk, CT (US)

( * ) Notice: Subject to any disclaimer, the term of this patent is extended or adjusted under 35 U.S.C. 154(b) by 357 days.

(21) Appl. No.: 13/110,783

(22) Filed: May 18, 2011

(65) Prior Publication Data

US 2012/0296568 A1 Nov. 22, 2012

(51) Int. Cl.
*G03G 5/047* (2006.01)
*G03G 5/10* (2006.01)
*G03G 5/06* (2006.01)

(52) U.S. Cl.
CPC ..... *G03G 5/047* (2013.01); *G03G 5/0614* (2013.01); *G03G 5/10* (2013.01)
USPC ..... 702/176; 430/58.05; 430/58.8

(58) Field of Classification Search
CPC .. G03G 5/0614; G03G 5/047; G03G 5/14708
USPC ..... 702/1, 57, 64, 65, 79, 151, 176; 430/58.8, 58.05, 56
See application file for complete search history.

(56) References Cited

U.S. PATENT DOCUMENTS 3,121,006 A 2/1964 Middleton et al.
4,265,990 A * 5/1981 Stolka et al. ..... 430/58.8
4,298,697 A 11/1981 Baczek et al.
4,338,390 A 7/1982 Lu
4,555,463 A 11/1985 Hor et al.
4,560,635 A 12/1985 Hoffend et al.
4,587,189 A 5/1986 Hor et al.
4,784,928 A 11/1988 Kan et al.
4,921,769 A 5/1990 Yuh et al.
5,055,366 A 10/1991 Yu et al.
5,178,980 A * 1/1993 Mort et al. ..... 430/58.05
5,473,064 A 12/1995 Mayo et al.
5,482,811 A 1/1996 Keoshkerian et al.
5,521,306 A 5/1996 Burt et al.
6,156,468 A 12/2000 Wehelie et al.
6,177,219 B1 1/2001 Yuh et al.
6,255,027 B1 7/2001 Wehelie et al.
7,259,390 B2 * 8/2007 Hanna et al. ..... 257/40
2004/0265716 A1 * 12/2004 Itami et al. ..... 430/58.8
2011/0063485 A1 * 3/2011 Nomura et al. ..... 348/294
2012/0292599 A1 * 11/2012 Klenkler et al. ..... 257/40

OTHER PUBLICATIONS

P. Cusumano and S.Gambino., "Space Charge and Carrier Trapping Effects on the Transient Photcurrents of Organic Materials Using the Time-of-Flight Technique", Nov. 21, 2007. Journal or Electronic Materials vol. 37, No. 3, pp. 231-239.*

Charge transport across pressure-laminated thin films of molecularly doped polymers, Applied Physics Letters, Klenkler et al., vol. 88, 2006, 3 pages.

* cited by examiner

*Primary Examiner* — Michael Nghiem
*Assistant Examiner* — Yoshihisa Ishizuka
(74) *Attorney, Agent, or Firm* — Pillsbury Winthrop Shaw Pittman LLP

(57) ABSTRACT

The present embodiments are generally directed to layers that are useful in imaging apparatus members and components, for use in electrophotographic, including digital, apparatuses. More particularly, the embodiments pertain to an electrophotographic imaging member having a charge transport layer in which a charge transport molecule (CTM) concentration gradient is formed through a single coating pass using only a single charge transport layer solution, and time-of-flight based methods of measuring the CTM gradient through the thickness of the charge transport layer.

20 Claims, 28 Drawing Sheets

METHODS FOR MEASURING CHARGE TRANSPORT MOLECULE GRADIENT

CROSS REFERENCE TO RELATED APPLICATIONS

Reference is made to commonly owned, U.S. patent application Ser. No. 13/110,755 and Pub. No. US 2012/0292599 A1 (abandoned on Jan. 27, 2014) to Klenkler et al., filed the same day as the present application, entitled, "Charge Transport Molecule Gradient", the entire disclosure of which are incorporated herein by reference in its entirety.

BACKGROUND

This disclosure is generally directed to layered imaging members, photoreceptors, photoconductors, and the like. More specifically, the present disclosure is directed to rigid or drum photoreceptors, and to multilayered flexible, belt imaging members, or devices comprised of an optional supporting medium like a substrate, a photogenerating layer, a charge transport layer, and a polymer coating layer, an optional adhesive layer, and an optional hole blocking or undercoat layer. The photoreceptors illustrated herein, in embodiments, have excellent wear resistance; extended lifetimes; provide for the elimination or minimization of imaging member scratches on the surface layer or layers of the member, and which scratches can result in undesirable print failures where, for example, the scratches are visible on the final prints generated; permit excellent electrical properties; minimum cycle up after extended electrical cycling, such as 10,000 simulated cycles; increased resistance to running deletion, know as LCM; and mechanical robustness. Additionally, in embodiments the imaging or photoconductive members disclosed herein possess excellent, and in a number of instances low Vr (residual potential), and the substantial prevention of Vr cycle up when appropriate; high sensitivity, and desirable toner cleanability.

Also included within the scope of the present disclosure are methods of imaging and printing with the photoreceptor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the photoreceptors disclosed herein can be selected for the Xerox Corporation iGEN3® and Nuvera® machines that generate with some versions over 100 copies per minute. Processes of imaging, especially xerographic imaging and printing, including digital, and/or color printing, are thus encompassed by the present disclosure. The imaging or photoconductive members disclosed are in embodiments sensitive in the wavelength region of, for example, from about 400 to about 900 nanometers, and in particular from about 650 to about 850 nanometers, thus diode lasers can be selected as the light source.

There is an intense competitive pressure to improve the functional performance of xerographic photoreceptors. For example, it is desirable to reduce Lateral Charge Migration (LCM) and improve mechanical strength. Also, it is desirable to minimize changes in its electrical characteristics during prolonged electrical cycling. The concentration of the charge transport molecules at the surface of the charge transport layer (CTL) is a known factor in the severity of lateral charge migration (LCM) caused by oxidation of the transport molecule. Also, the concentration of the charge transport molecule in the bulk CTL is a known factor in the formation of printable stress cracks in PR devices. The lower the concentration of the transport molecule at the surface, the lower the severity of LCM. Also, the lower the concentration of the transport molecule in the bulk, the less susceptible the device will be to printable cracks. The presently disclosed embodiments relate to an imaging or photoconductive member having a charge transport layer in which a charge transport molecule (CTM) concentration gradient, wherein the concentration of the CTM is lower at the surface of the CTL than it is toward the substrate side of the CTL.

REFERENCES

U.S. Pat. No. 5,055,366, the disclosure of which is totally incorporated herein by reference, discloses an overcoat layer containing a film forming binder material or polymer blend doped with a charge transport compound. The charge transport compound is present in an amount of less than about 10 percent by weight. Alternatively, the overcoat layer may contain a single component hole transporting carbazole polymer or polymer blend of a hole transport carbazole polymer with a film forming binder.

U.S. Pat. No. 4,784,928, the disclosure of which is totally incorporated herein by reference, discloses a reusable electrophotographic element comprising first and second charge transport layers. The second charge transport layer contains irregularly shaped fluorotelomer particles, an electrically nonconductive substance, dispersed in a binder resin. The second charge transport layer allows for toner to be uniformly transferred to a contiguous receiver element with minimal image defects.

Layered imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N-diphenyl-N,N'-bis(3-methylphenyl)-1,1'-biphenyl-4,4'-diamine, dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent; and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene (DI 3) in an amount of from about 1 part to about 10 parts, and preferably about 4 parts of DI 3, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Also in the journal article Klenkler, R. A., Xu, G., Graham, J. F., and Popovic, Z. D., Charge transport across pressure-laminated thin films of molecularly-doped polymers. *Applied Physics Letters* 88 (2006): 102101-3, which is hereby incorporated by reference, there is illustrated the process for using a pressure contacted top electrode for time-of-flight photocurrent transient measurements of a photoreceptor.

SUMMARY

According to aspects illustrated herein, there is provided a method of measuring a charge transport molecule gradient in a charge transport layer comprising: measuring photocurrent transients of charge transport from a substrate-to-surface side of the charge transport layer by time-of-flight measurements with, in embodiments, an electric field intensity of 10 V/μm; measuring photocurrent transients of charge transport from a surface-to-substrate side of the charge transport layer by time-of-flight measurements with an electric field intensity of 10 V/μm; calculating a difference δ of the photocurrent transients based on $$\delta=\alpha-\beta$$

wherein α is a slope of the plateau region of the substrate-to-surface transient, and β is a slope of the plateau region of the surface-to-substrate transient.

Another embodiment provides a method of measuring a charge transport molecule gradient in a charge transport layer comprising: providing a sample cell for time-of-flight measurements comprising a support substrate, a first electrode, a charge transport layer, a second electrode, and a top substrate; measuring photocurrent transients of charge transport from a substrate-to-surface side of the charge transport layer by time-of-flight measurements with, in embodiments, an electric field intensity of 10 V/μm applied to the sample cell; measuring photocurrent transients of charge transport from a surface-to-substrate side of the charge transport layer by time-of-flight measurements with an electric field intensity of 10 V/μm applied to the sample cell; calculating a difference δ of the photocurrent transients based on $$\delta=\alpha-\beta$$

wherein α is a slope of the plateau region of the substrate-to-surface transient, and β is a slope of the plateau region of the surface-to-substrate transient.

Yet another embodiment, there is provided a method of measuring a charge transport molecule gradient in a charge transport layer comprising: providing a sample cell for time-of-flight measurements comprising a support substrate, a first electrode, a charge transport layer, a second electrode, and a top substrate, wherein a charge generation layer is disposed either between the first electrode and charge transport layer or between the charge transport layer and the second electrode; measuring photocurrent transients of charge transport from a substrate-to-surface side of the charge transport layer by time-of-flight measurements with, in embodiments, an electric field intensity of 10 V/μm applied to the sample cell; measuring photocurrent transients of charge transport from a surface-to-substrate side of the charge transport layer by time-of-flight measurements with an electric field intensity of 10 V/μm applied to the sample cell; calculating a difference δ of the photocurrent transients based on wherein α is a slope of the plateau region of the substrate-to-surface transient, and β is a slope of the plateau region of the surface-to-substrate transient.

BRIEF DESCRIPTION OF THE DRAWINGS

For a better understanding, reference may be made to the accompanying figures.

DETAILED DESCRIPTION

Figure 1A:
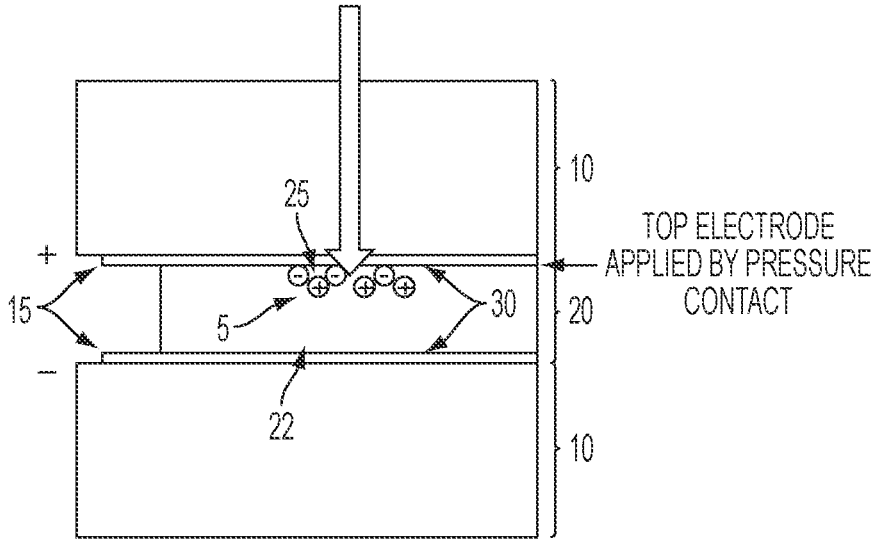
FIG. 1A illustrates a cross section of a sample cell used for time-of-flight measurements of the charge transport layers according to the present embodiments where charge is generated at the surface side of the CTL directly in the CTL.

In an electrostatographic reproducing apparatus for which the photoreceptors of the present disclosure can be selected, a light image of an original to be copied is recorded in the form of an electrostatic latent image upon a photosensitive member, and the latent image is subsequently rendered visible by the application of electroscopic thermoplastic resin particles, which are commonly referred to as toner. Specifically, the photoreceptor is charged on its surface by means of an electrical charger to which a voltage has been supplied from a power supply. The photoreceptor is then imagewise exposed to light from an optical system or an image input apparatus, such as a laser and light emitting diode, to form an electrostatic latent image thereon. Generally, the electrostatic latent image is developed by a developer mixture of toner and carrier particles. Development can be accomplished by known processes, such as a magnetic brush, powder cloud, highly agitated zone development, or other known development process.

After the toner particles have been deposited on the photoconductive surface in image configuration, they are transferred to a copy sheet by a transfer means, which can be pressure transfer or electrostatic transfer. In embodiments, the developed image can be transferred to an intermediate transfer member, and subsequently transferred to a copy sheet.

When the transfer of the developed image is completed, a copy sheet advances to the fusing station with fusing and pressure rolls, wherein the developed image is fused to a copy sheet by passing the copy sheet between the fusing member and pressure member, thereby forming a permanent image. Fusing may be accomplished by other fusing members, such as a fusing belt in pressure contact with a pressure roller, fusing roller in contact with a pressure belt, or other like systems.

Aspects of the present disclosure relate to a drum or flexible imaging member comprising a conductive support, an optional undercoating layer, a photogenerating layer, a charge transport layer, and optionally an overcoat layer In the present embodiments, the charge transport layer is deposited on the photogenerating layer in a single pass. More specifically, there is disclosed herein a photoreceptor comprised of a supporting substrate, a hole blocking layer, an adhesive layer, a photogenerating layer, a charge transport layer formed by a single pass, single solution coating method and having a thickness, for example, of from about 1 to about 100 microns, from about 10 to about 50 microns, or from about 5 to about 30 microns.

Furthermore, in the present embodiments, the charge transport layer has a specific charge transport material (CTM) concentration gradient. Thus, the present embodiments provide a charge transport layer having a specific concentration gradient and methods for characterizing the same. The concentration gradient in the transport layer is formed through a single solution, single pass coating method using cyclohexyl polycarbonate (PCZ) or bisphenol A polycarbonate (PCA) prepared in specific solvents, such as for example, tetrahydrofuran (THF) and dichloromethane (DCM) solvent, with N,N'-diphenyl-N,N' bis(3-methylphenyl)-[1,1'-biphenyl]-4,4'diamine (TPD) transport molecule. Thus, the present embodiments provide a simpler and more efficient method of making an imaging member with a CTM concentration gradient in the charge transport layer. Not only is this charge transport layer easier to coat in production, but it also exhibits significant improvements in the performance of the imaging member (e.g., increased resistance to deletion (LCM), negligible changes during prolonged electrical cycling, and improved wear and cracking resistance).

Increasing binder molecular weight and solvent type has been observed to increase the steepness of the concentration gradient with the greater concentration at the substrate surface. Evidence of the gradient is obtained through mobility transients measured in charge transport layer coatings. Imaging members made with the charge transport layer of the present embodiments exhibited similar photoinduced discharge characteristics as current production devices. The imaging members with lower CTM concentration at the surface gave prints that showed less deletion than samples with higher CTM concentration at the surface.

In embodiments, the charge transport layer has a CTM gradient in which the highest concentration is in the bottom of the charge transport layer and the concentration decreases in a direction towards the top of the charge transport layer, so that the lowest concentration is at the surface of the charge transport layer. In embodiments, the CTM concentration gradient in the CTL is revealed by a comparison of time-of-flight photocurrent transients measuring transport from the substrate-to-surface side of the CTL as compared to transport from the surface-to-substrate side of the CTL. Specifically, the magnitude and direction of the CTM concentration gradient is defined by the differences between the slopes of the respective plateau regions of the surface-to-substrate versus substrate-to-surface time-of-flight photocurrent transients.

In specific embodiments, the charge transport molecule may be a tri-arylamine having the following formula:

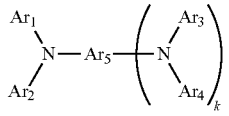

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1. $Ar^5$ may be further defined as, for example, a substituted phenyl ring, substituted/unsubstituted phenylene, substituted/unsubstituted monovalently linked aromatic rings such as biphenyl, terphenyl, and the like, or substituted/unsubstituted fused aromatic rings such as naphthyl, anthranyl, phenanthryl, and the like. In further embodiments, the tri-arylamine may be selected from any of the following group:

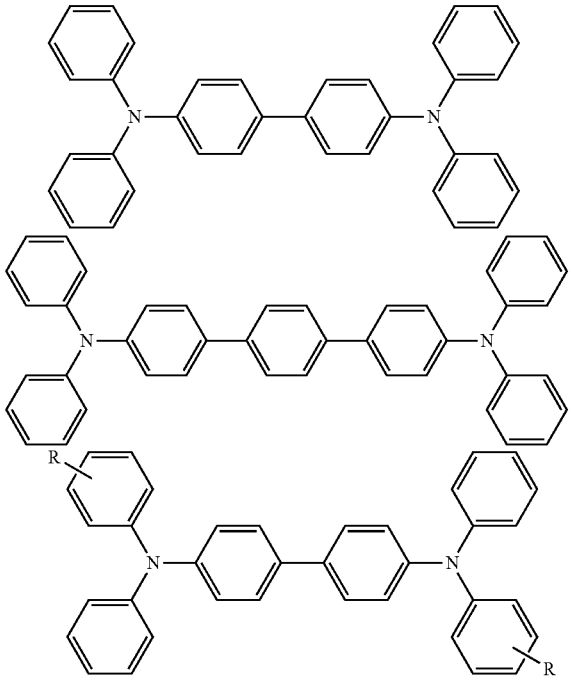

-continued

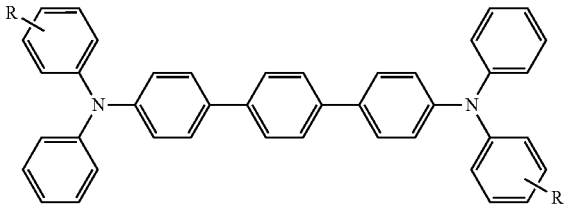

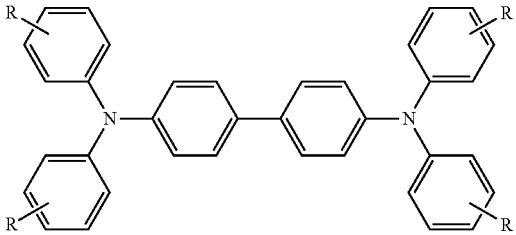

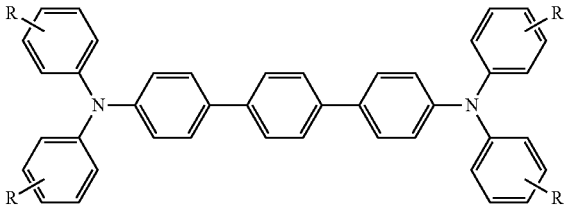

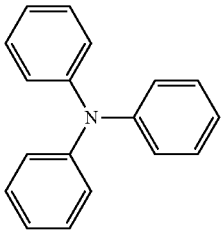

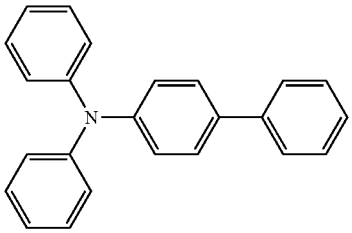

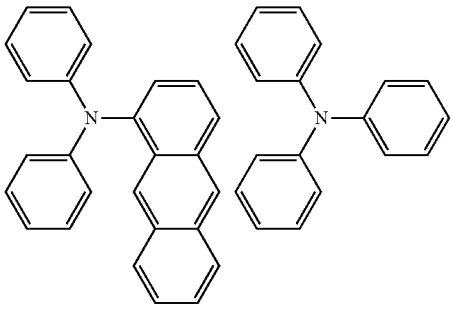

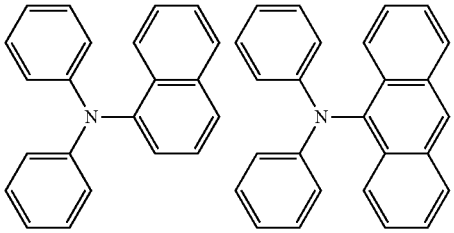

-continued

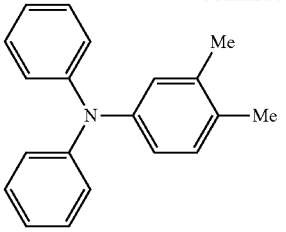

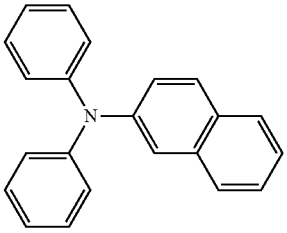

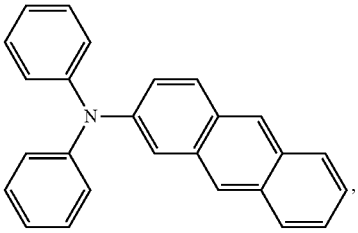

and mixtures thereof, wherein R represents a hydrogen atom, an aryl group, or an alkyl group optionally containing a substituent. In specific embodiments, the binder for the charge transport layer may be selected from the group consisting of poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), In specific embodiments, the solvent may be selected from the group consisting of methylene chloride, tetrahydrofuran, monochlorobenzene, toluene, methylethylketone, and mixtures thereof.

To evaluate the concentration gradient in a charge transport layer, 2 time-of-flight (TOF) measurements are performed on a sample: one measurement is performed in which hole charge is generated at the surface of the transport layer and driven down to the substrate; and a second measurement is performed in which hole charge is generated at the substrate side of the transport layer and driven up to the surface. Each of these measurements is performed under identical conditions, so as to provide a comparison based only on the direction of charge transport of hole photocurrent through the charge transport layer.

The ability to measure charge transport in either direction through the charge transport layer can be achieved in one of two ways. If the charge transport layer is coated directly on a semitransparent conductive substrate and a semitransparent conductive electrode is applied to the surface of the charge transport layer then charge can be generated directly in the charge transport layer itself. This is achieved by performing the TOF measurement where charge is photogenerated by shining a pulse of light at a wavelength near the maximum absorption of the transport molecule in the charge transport layer. Charge can be generated either at the substrate or surface side of the CTL by shining the wavelength tuned pulse of light either through the substrate electrode or through the surface electrode, respectively.

Alternately, if the charge transport layer is coated on a conductive substrate that is overcoated with a charge generator layer, as in a typical bi-layer photoreceptor, then charge can be generated in the generator layer and transported from the substrate side of the transport layer to the surface. Conversely, to measure transport from the surface side of the transport layer down to the substrate, a sample is prepared wherein the surface of the charge transport layer is overcoated with a second generator layer. This overcoated generator layer thus allows for charge to be generated and injected into the surface side of the CTL and transported down to the substrate. Charge can be generated exclusively in the generator layer, as opposed to the transport layer, by choosing a generator layer material with an optical absorption peak that is complementary to that of the transport layer materials. Thus, during the time-of-flight measurement charge is photogenerated exclusively in the generator layer by shining a pulse of light at a wavelength that is minimally absorbed in the transport layer but is maximally absorbed in the pigment or dye in the generator layer.

In the embodiments the latter method of generating charge in a separate charge generator layer is preferable. Use of a separate charge generator layer allows for the ability to examine devices prepared on a opaque support, such as a charge transport layer integrated in a photoreceptor device on a aluminum drum.

Figure 1B:
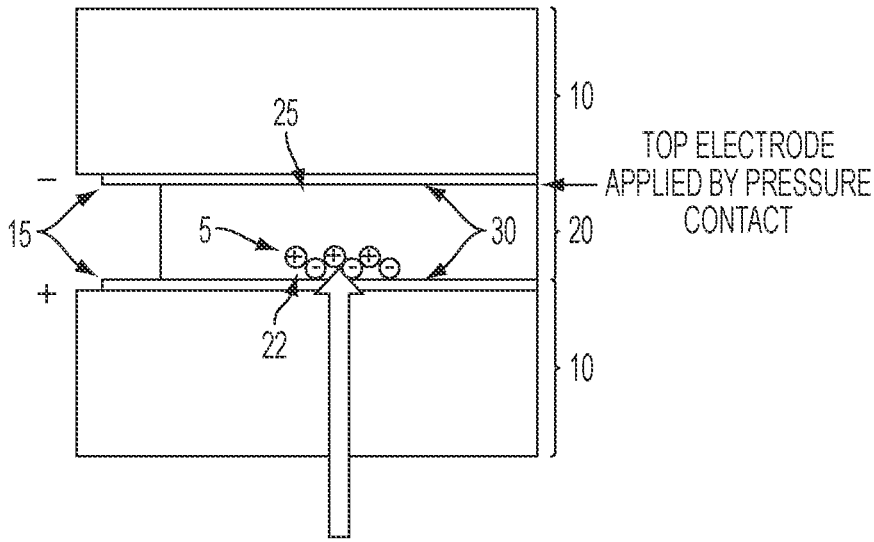
FIG. 1B illustrates a cross section of a sample cell used for time-of-flight measurements of the charge transport layers according to the present embodiments where charge is generated at the substrate side of the CTL directly in the CTL.

FIGS. 1A and 1B illustrate the cross section of the sample cells used for the time-of-flight measurements, wherein charge 5 is generated directly in the charge transport layer. FIG. 1A illustrates where the charge is generated at the surface side of the CTL 25 and FIG. 1B illustrates where the charge is generated at the substrate side of the CTL 22. The charge transport layer sample is prepared as described above. The sample charge transport layer 20 is coated onto a semi-transparent conductive support that is overcoated with, in embodiments, about 0.05 to 0.5 um layer of silane 30 (the metal electrode 15 followed by the silane layer 30 is disposed on top of support substrate 10), allowed to dry for 12 hours under ambient conditions and then heat treated in a forced air vented oven at 120 C for 30 mins and then allowed to cool to ambient temperature. The time-of-flight sample cell is then assembled by applying a top electrode assembly (which includes 10, 15, 30) (e.g., semitransparent metalized support substrate) by pressure contact onto the surface 25 of the charge transport layer sample 20, so as to sandwich the CTL 20 between the top and bottom electrode assemblies (which includes 10, 15, 30). With use of a compressing apparatus (with a transparent window so that the light for the time-of-flight measurement can reach the CTL with minimum attenuation), 1 MPa pressure is applied to create an intimate contact between the top electrode assembly (which includes 10, 15, 30) and the CTL sample surface 25. The time-of-flight measurements can then be taken where charge is generated at the surface side 25 of the charge transport layer 20 and driven down to the substrate side 22 of the charge transport layer 20, or conversely, the charge is generated at the substrate side 22 of the charge transport layer 20 and driven up to the surface side 25. For a CTL consisting of N,N'-diphenyl-N,N'bis(3-methylphenyl)-[1,1'-biphenyl]-4,4'diamine (TPD) and polycarbonate, charge was generated directly in the CTL with an ~10 ns light pulse at 337 nm wavelength. In embodiments, the electrodes 15 may comprise a metal including for example zirconium, titianium, aluminum, chromium, nickel, silver, gold, indum-tin oxide, Poly(3,4-ethylenedioxythiophene) poly(styrenesulfonate) (PEDOT:PSS) and mixtures thereof.

Figure 2A:
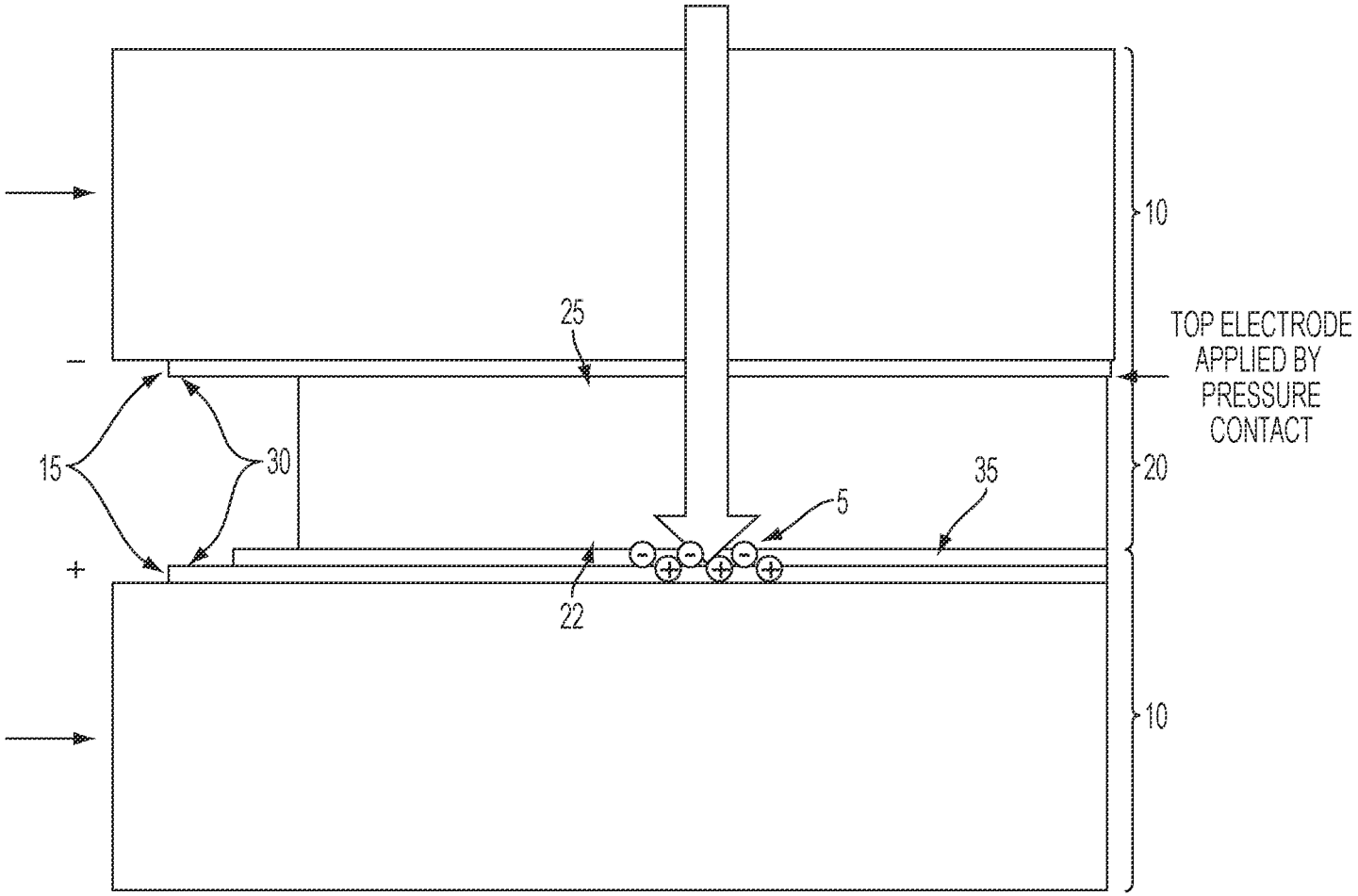
FIG. 2A illustrates a cross section of a sample cell used for time-of-flight measurements of the charge transport layers according to the present embodiments where charge is generated at the substrate side of the CTL in a separate generator layer neighboring the CTL.
Figure 2B:
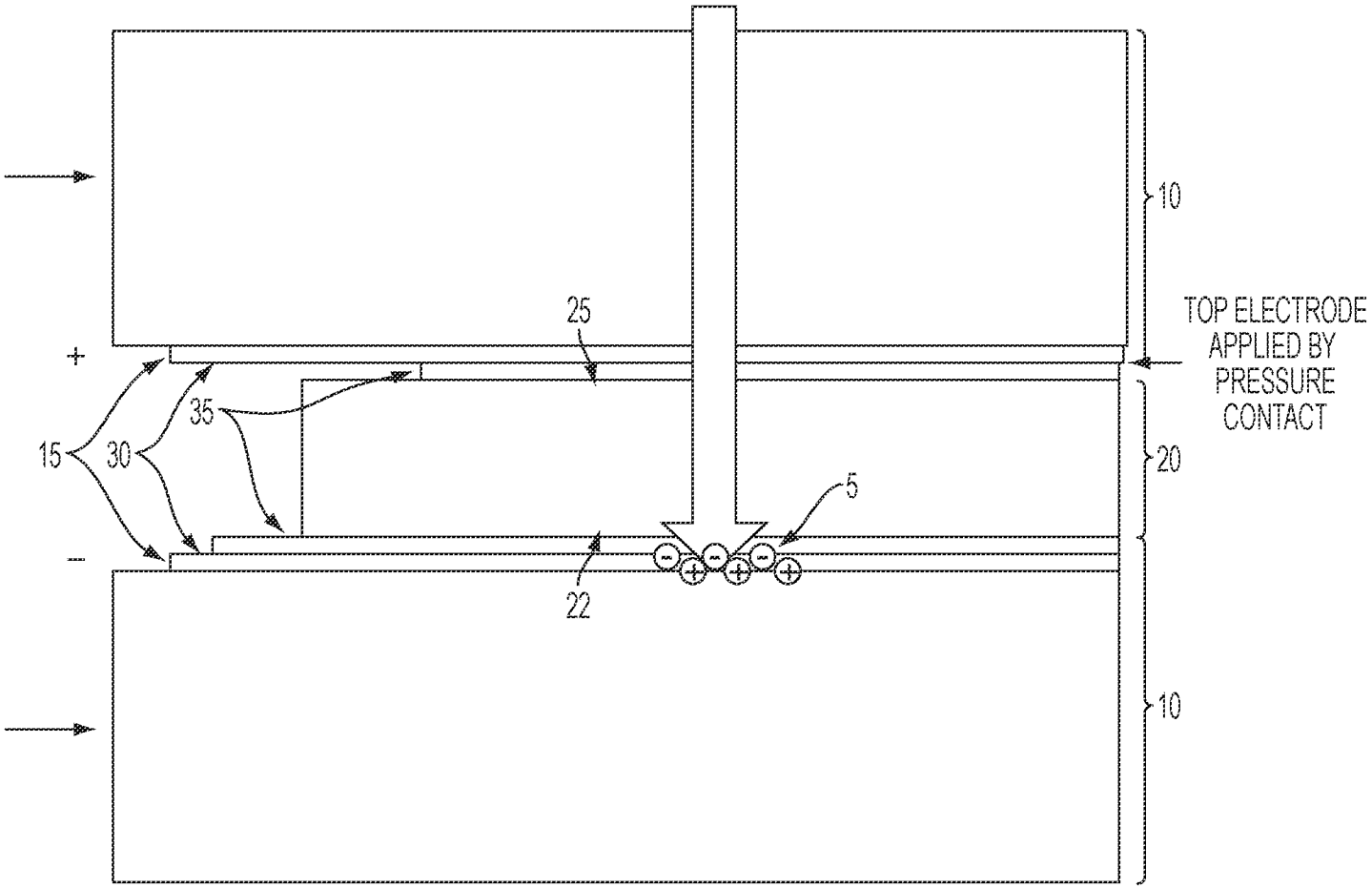
FIG. 2B illustrates a cross section of a sample cell used for time-of-flight measurements of the charge transport layers according to the present embodiments where charge is generated at the surface side of the CTL in a separate generator layer neighboring the CTL.

FIGS. 2A and 2B illustrate the cross section of the sample cells used for the time-of-flight measurements, wherein charge is generated in a separate generator layer 35 neighboring the charge transport layer 20. The charge transport layer sample is prepared as described above. In embodiments, the charge transport layer 20 has a thickness of from about 20 μm to 30 μm. Use of the charge generator layer allows for the charge transport molecule gradient in a photoreceptor on an opaque substrate 10, such as a drum photoreceptor, to be evaluated. Thus, in these embodiments, to generate a charge 5 at the substrate side of the CTL 22, the device is structured so that the pigment-containing layer 35 is located at the substrate side of the CTL 22, as shown for example in FIG. 2A. To generate charge at the surface side of the CTL 25, the device is structured so that the pigment-containing layer 35 is located at the surface side of the CTL 25, as shown for example in FIG. 2B. These generator layer containing samples are prepared in a similar manner as described above. The sample in FIG. 2A is prepared by overcoating a metalized support substrate 10 with an about 0.1 um layer of silane 30, and then an about 0.5 um charge generator layer 35. The sample charge transport layer 20 is then coated onto the generator layer 35 coated conductive support substrate 10 (the metal electrode 15 followed by the silane layer 30, followed by the generator layer 35 is disposed on top of support substrate 10), allowed to dry for 12 hours under ambient conditions and then heat treated in a forced air vented oven at 120 C for 30 mins and then allowed to cool to ambient temperature. The sample in FIG. 2B is prepared by coating the sample charge transport layer 20 onto a conductive support 10 that is overcoated with silane 30 and then an about 0.5 um charge generator layer 35 (the metal electrode 15 followed be the silane layer 30 and the charge generator layer 35 are disposed on top of support substrate 10). The charge transport layer 20 is then allowed to dry for 12 hours under ambient conditions and then heat treated in a forced air vented oven at 120° C. for 30 mins and then allowed to cool to ambient temperature. The sample charge transport layer is then overcoated with an about 0.5 um charge generation layer 35. In either case, the time-of-flight sample cells are then assembled in a similar manner as described above. In particular, the time-of-flight sample cell is assembled by applying a top electrode assembly (which includes 10, 15, 30) (e.g., semi-transparent metalized support substrate) by pressure contact, so as to sandwich the CTL 20 and CGL 35 between the top and bottom electrode assemblies (which include 10, 15, 30). With use of a compressing apparatus (with a transparent window so that the light for the time-of-flight measurement can reach the CTL with minimum attenuation), 1 MPa pressure is applied to create an intimate contact between the top electrode assembly (which includes 10, 15, 30) and the CTL sample surface 25. For a charge transport layer comprising of N,N'-diphenyl-N,N'bis(3-methylphenyl)-[1,1'-biphenyl]-4,4'diamine (TPD) and polycarbonate and a charge generator layer comprising of hydroxygallium phthalocyanine and polycarbonate, charge was generated exclusively in the generator layer with about 10 ns light pulse at 650 nm wavelength.

With the above-described method, it is possible to evaluate the CTM concentration gradient in the CTL by comparing the charge transport from the surface down to the substrate to the conventional charge transport from the substrate up to the surface. Several different charge transport layer formulations were compared in this manner, using the variation of the method where charge is generated directly in the CTL. The results are shown in FIGS. 3A-3G.

Figure 3A:
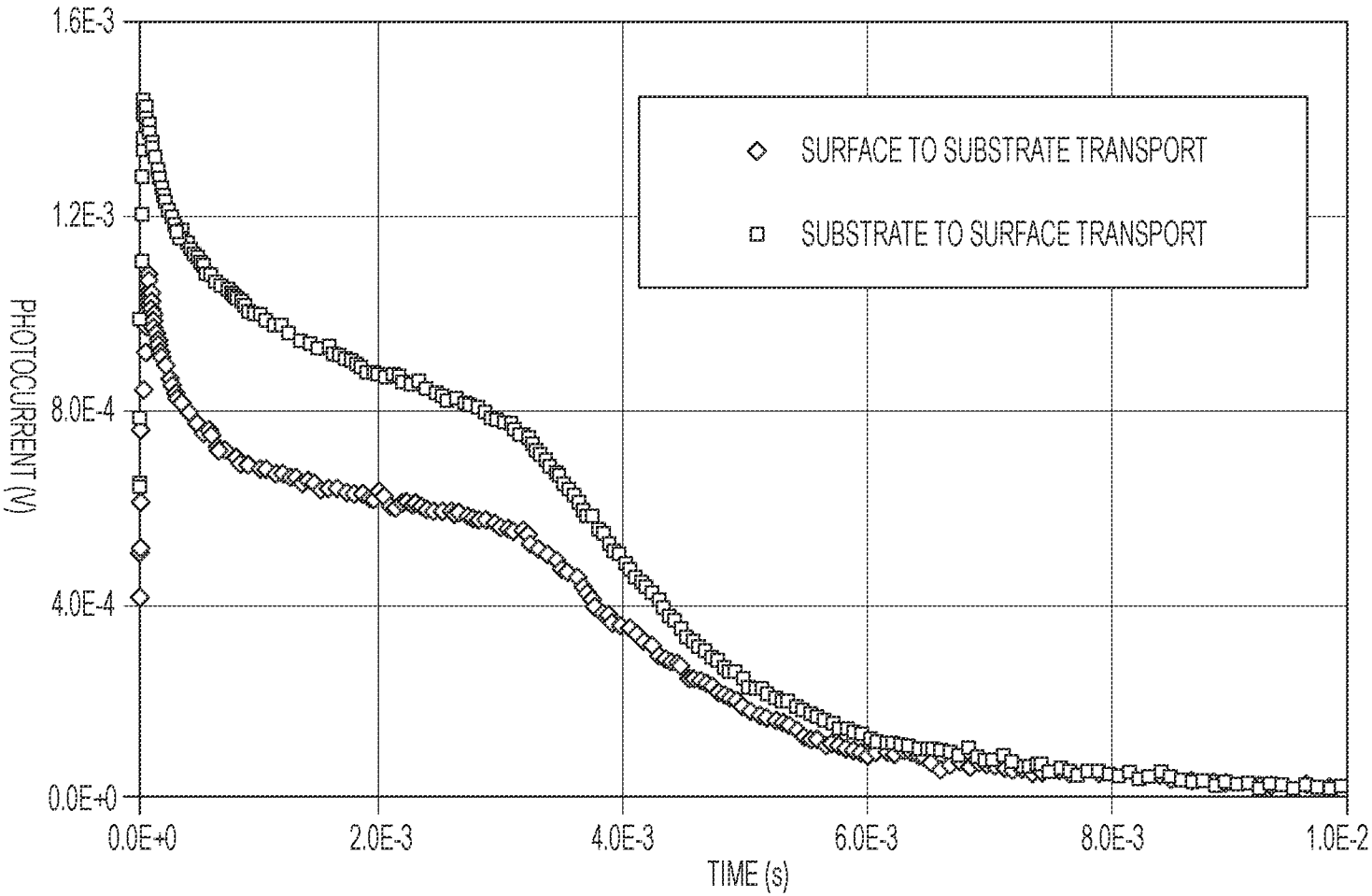
FIG. 3A is a graph illustrating the time-of-flight measurements taken where charge is generated directly in the CTL of a charge transport layer formulated according to the present embodiments.

FIG. 3A illustrates the time-of-flight measurement of Sample 1, where charge is generated directly in the CTL via an ultraviolet (UV) light pulse for a charge transport layer cast from a solution of 50 wt % triphenyldiamine (TPD) and 50 wt % PCZ-200® (MITSUBISHI GAS CHEMICAL COMPANY INC., bisphenol Z polycarbonate having a molecular weight of about 20,000) in dichloromethane having a 40% solids content. The charge transport layer had a thickness of 30 μm and the time-of-flight measurement was performed at an electric field of 10 V/μm.

Figure 3B:
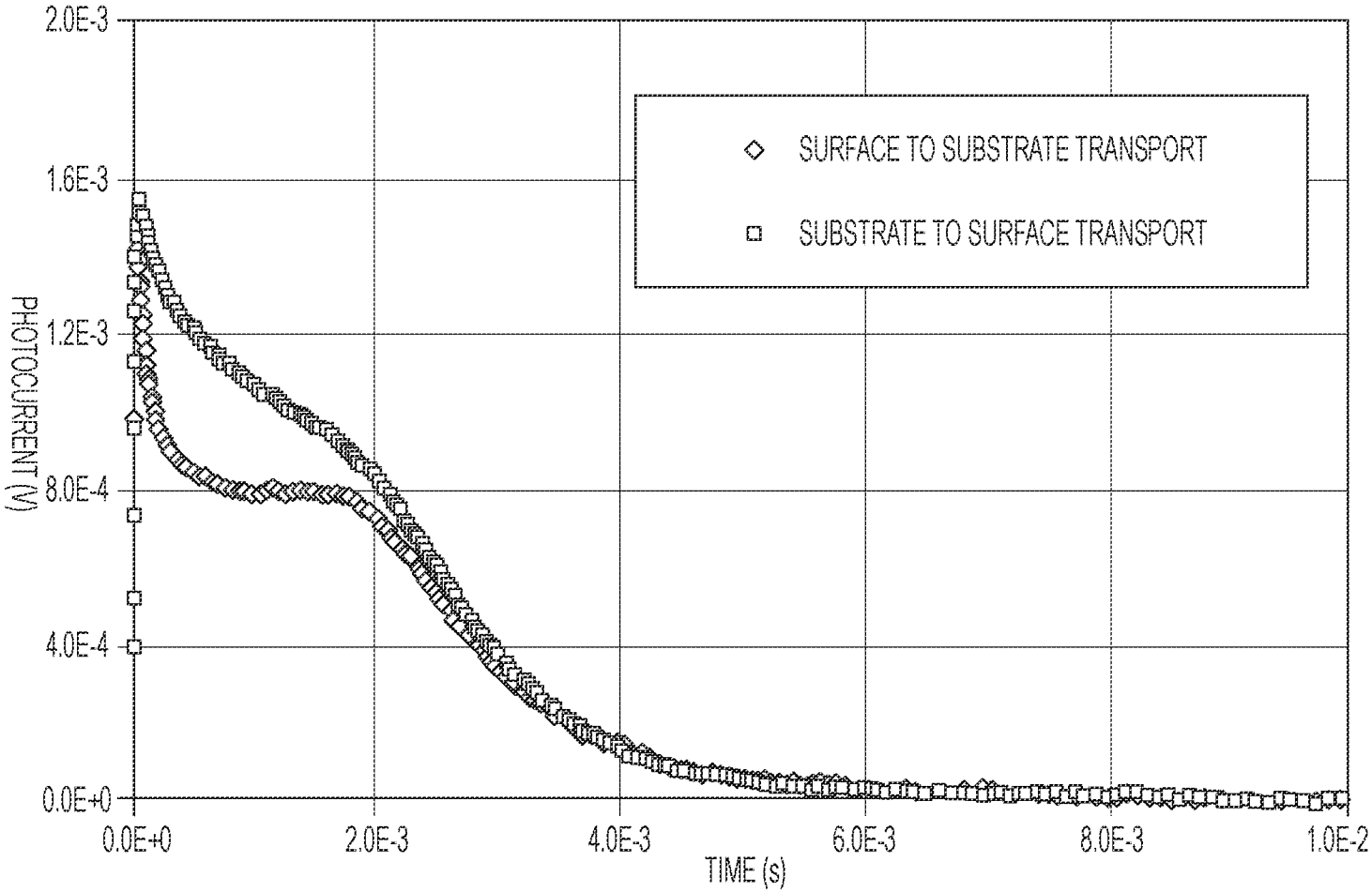
FIG. 3B is a graph illustrating the time-of-flight measurements taken where charge is generated directly in the CTL of another charge transport layer formulated according to the present embodiments.

FIG. 3B illustrates the time-of-flight measurement of Sample 2, where charge is generated directly in the CTL via an UV light pulse for a charge transport layer cast from a solution of 50 wt % TPD and 50 wt % PCZ-400® (MITSUBISHI GAS CHEMICAL COMPANY INC., bisphenol Z polycarbonate having a molecular weight of about 40,000) in dichloromethane having a 28% solids content. The charge transport layer had a thickness of 24 μm and the time-of-flight measurement was performed at an electric field of 10 V/μm.

Figure 3C:
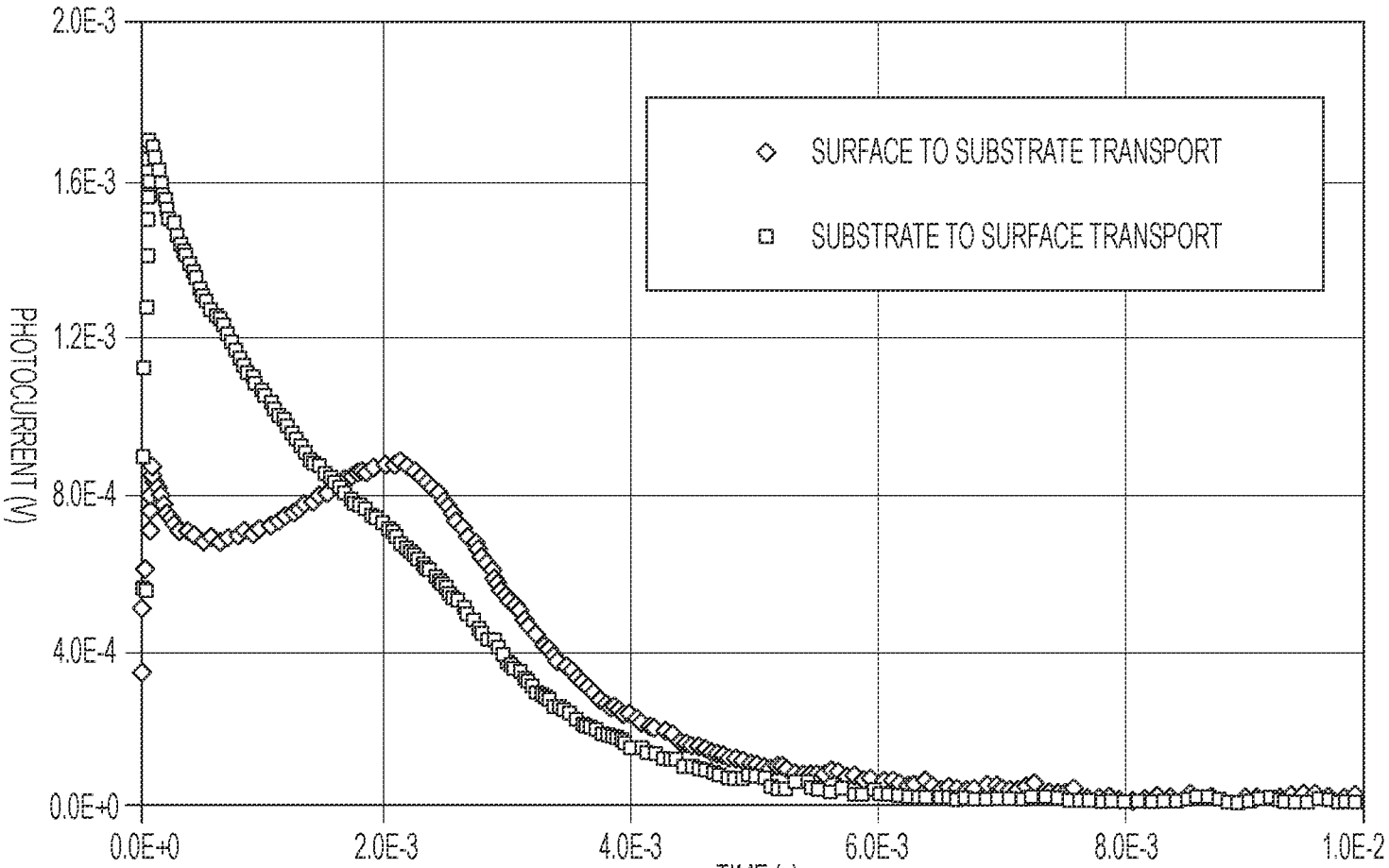
FIG. 3C is a graph illustrating the time-of-flight measurements taken where charge is generated directly in the CTL of another charge transport layer formulated according to the present embodiments.

FIG. 3C illustrates the time-of-flight measurement of Sample 3, where charge is generated directly in the CTL via an UV light pulse for a charge transport layer cast from a solution of 50 wt % TPD and 50 wt % PCZ-800® (MITSUBISHI GAS CHEMICAL COMPANY INC., bisphenol Z polycarbonate having a molecular weight of about 80,000) in dichloromethane having a 17% solids content. The charge transport layer had a thickness of 26 μm and the time-of-flight measurement was performed at an electric field of 10 V/μm.

Figure 3D:
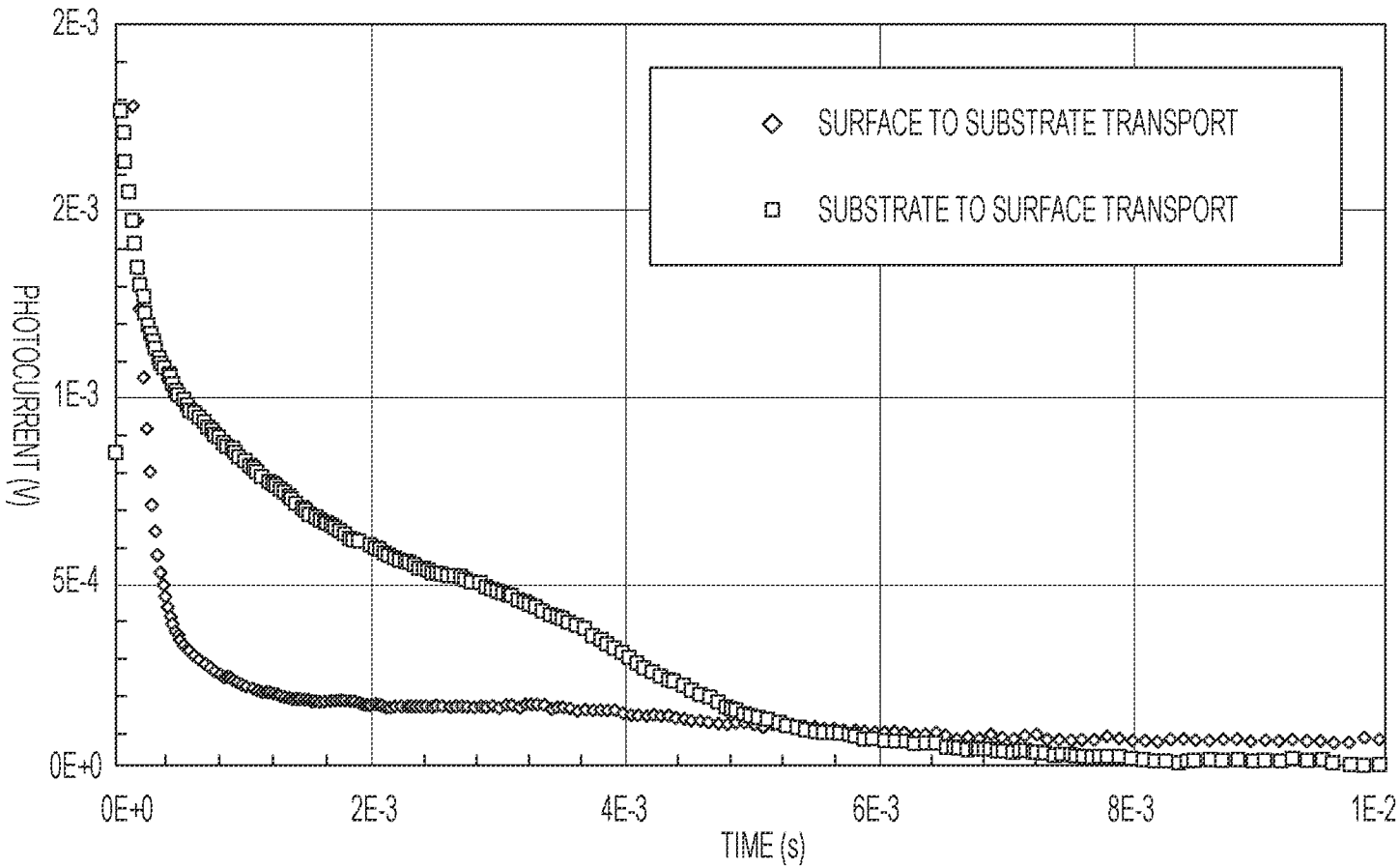
FIG. 3D is a graph illustrating the time-of-flight measurements taken where charge is generated directly in the CTL of another charge transport layer formulated according to the present embodiments.

FIG. 3D illustrates the time-of-flight measurement of Sample 4, where charge is generated directly in the CTL via an UV light pulse for a charge transport layer cast from a solution of 50 wt % TPD and 50 wt % Makrolon 5705® (Farbenfabriken Bayer A.G., bisphenol A polycarbonate having a molecular weight from about 50,000 to about 100,000) in dichloromethane having a 17% solids content. The charge transport layer had a thickness of 40 μm and the time-of-flight measurement was performed at an electric field of 10 V/μm.

Figure 3E:
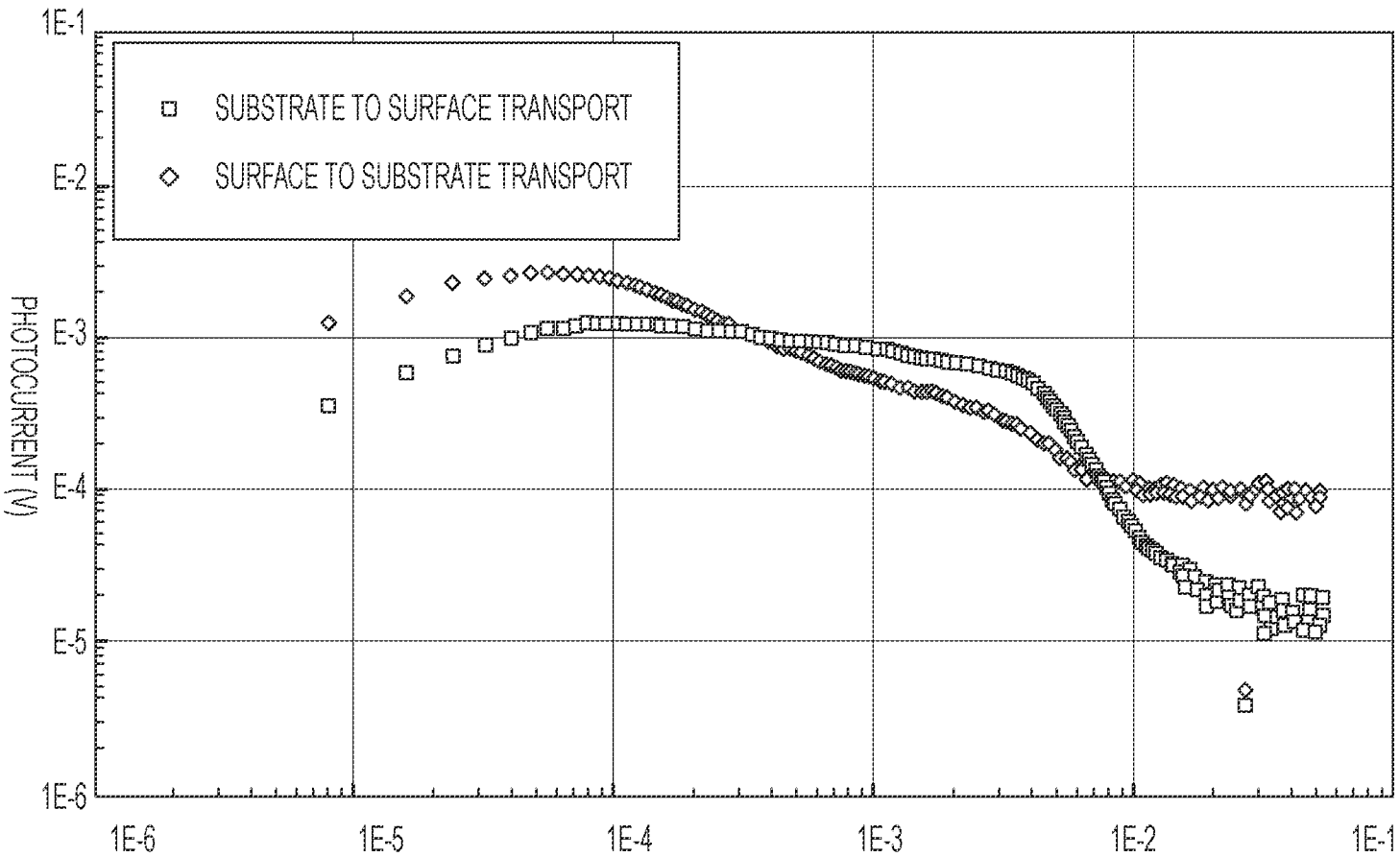
FIG. 3E is a graph illustrating the time-of-flight measurements taken where charge is generated directly in the CTL of another charge transport layer formulated according to the present embodiments.

FIG. 3E illustrates the time-of-flight measurement of Sample 5, where charge is generated directly in the CTL via an UV light pulse for a charge transport layer cast from a solution of 50 wt % TPD and 50 wt % PCZ-200® (MITSUBISHI GAS CHEMICAL COMPANY INC., bisphenol Z polycarbonate having a molecular weight of about 20,000) in tetrahydrofuran having a 44% solids content. The charge transport layer had a thickness of 27 μm and the time-of-flight measurement was performed at an electric field of 10 V/μm.

Figure 3F:
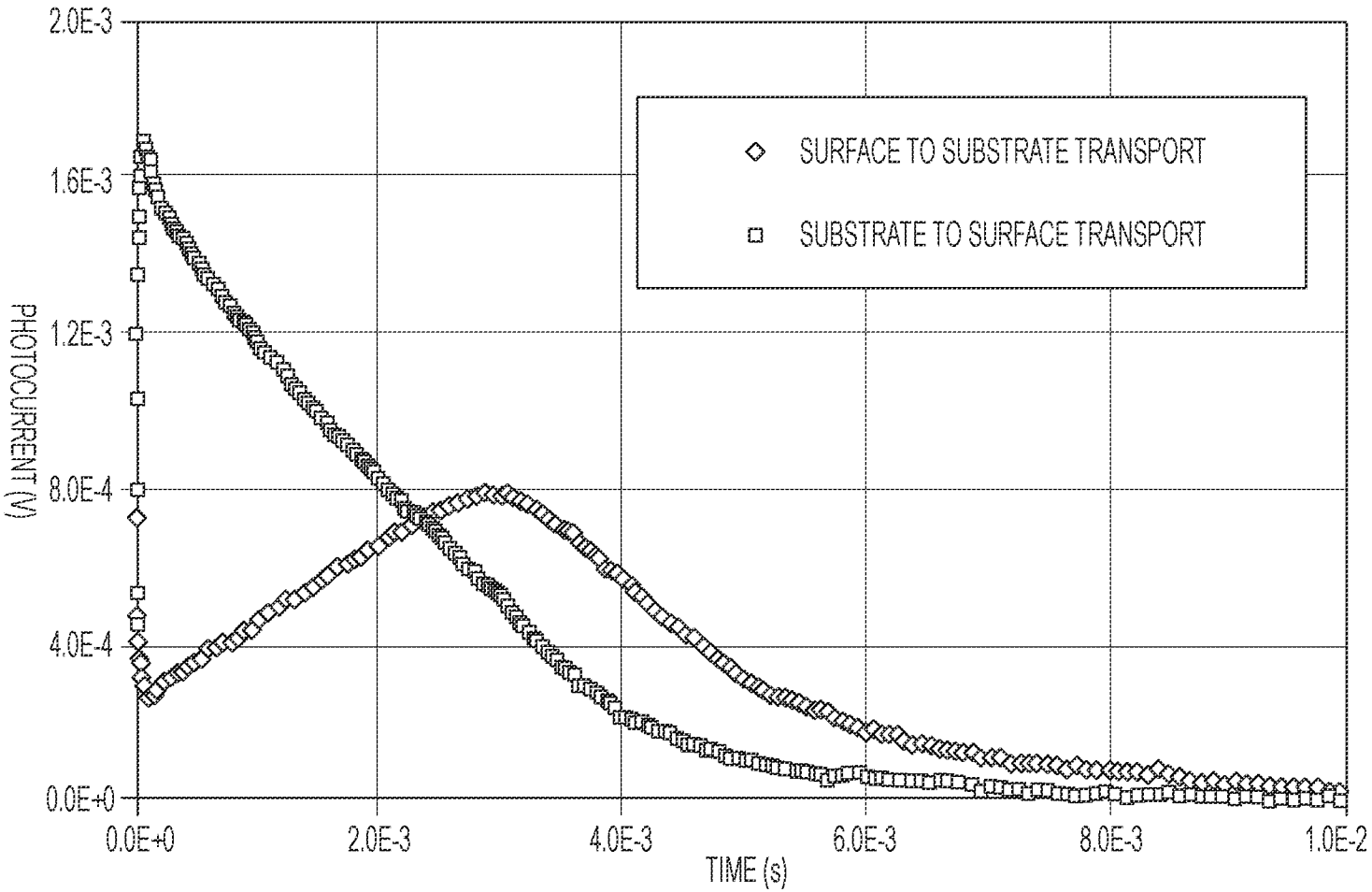
FIG. 3F is a graph illustrating the time-of-flight measurements taken where charge is generated directly in the CTL of another charge transport layer formulated according to the present embodiments.

FIG. 3F illustrates the time-of-flight measurement of Sample 6, where charge is generated directly in the CTL via an UV light pulse for a charge transport layer cast from a solution of 50 wt % TPD and 50 wt % PCZ-400® (MITSUBISHI GAS CHEMICAL COMPANY INC., bisphenol Z polycarbonate having a molecular weight of about 40,000) in tetrahydrofuran having a 34% solids content. The charge transport layer had a thickness of 34 μm and the time-of-flight measurement was performed at an electric field of 10 V/μm.

Figure 3G:
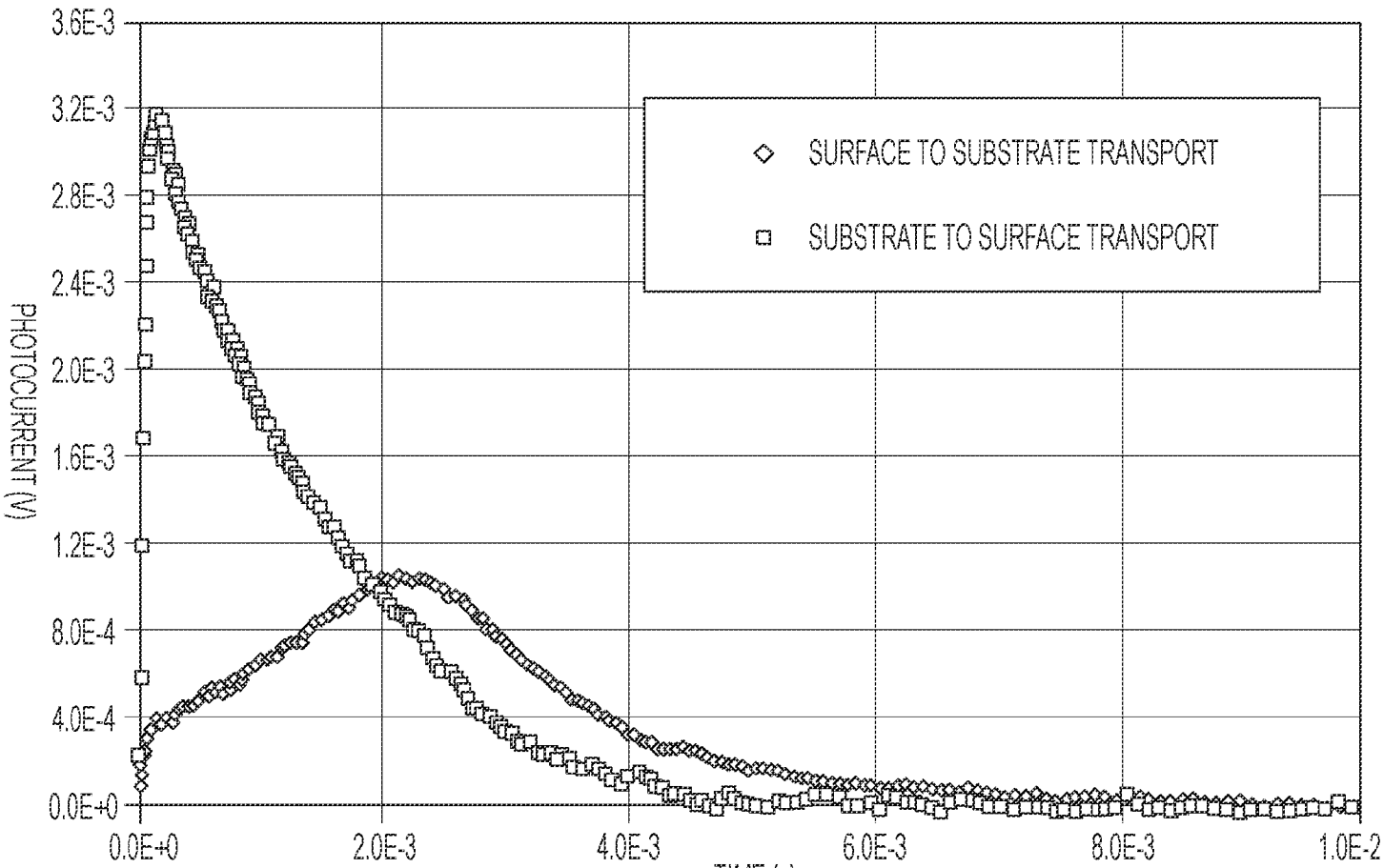
FIG. 3G is a graph illustrating the time-of-flight measurements taken where charge is generated directly in the CTL of another charge transport layer formulated according to the present embodiments.

FIG. 3G illustrates the time-of-flight measurement of Sample 7 where charge is generated directly in the CTL via an UV light pulse for a charge transport layer cast from a solution of 50 wt % TPD and 50 wt % PCZ-800® (MITSUBISHI GAS CHEMICAL COMPANY INC., bisphenol Z polycarbonate having a molecular weight of about 80,000) in tetrahydrofuran having a 24% solids content. The charge transport layer had a thickness of 30 μm and the time-of-flight measurement was performed at an electric field of 10 V/μm.

With the time-of-flight method, photocurrent flowing through the CTL is plotted as a function of time and the resultant curve is referred to as a transient. If the CTM is homogeneously distributed through the CTL, then the transient for charge transport from the surface down to the substrate side of the CTL should be identical to that of charge transport from substrate up to the surface side of the CTL. This appears to be the case for Sample 1 for which the photocurrent transients are shown in FIG. 3A. Aside from the fact that the overall photocurrent for the substrate-to-surface transient (top curve) is somewhat greater than that of the surface-to-substrate transient (bottom curve), the two transients have a similar shape. Most importantly, the two transients have similarly sloping plateaus indicating that transport through the CTL occurs at the same rate, independent of the direction of charge transport.

Figure 4:
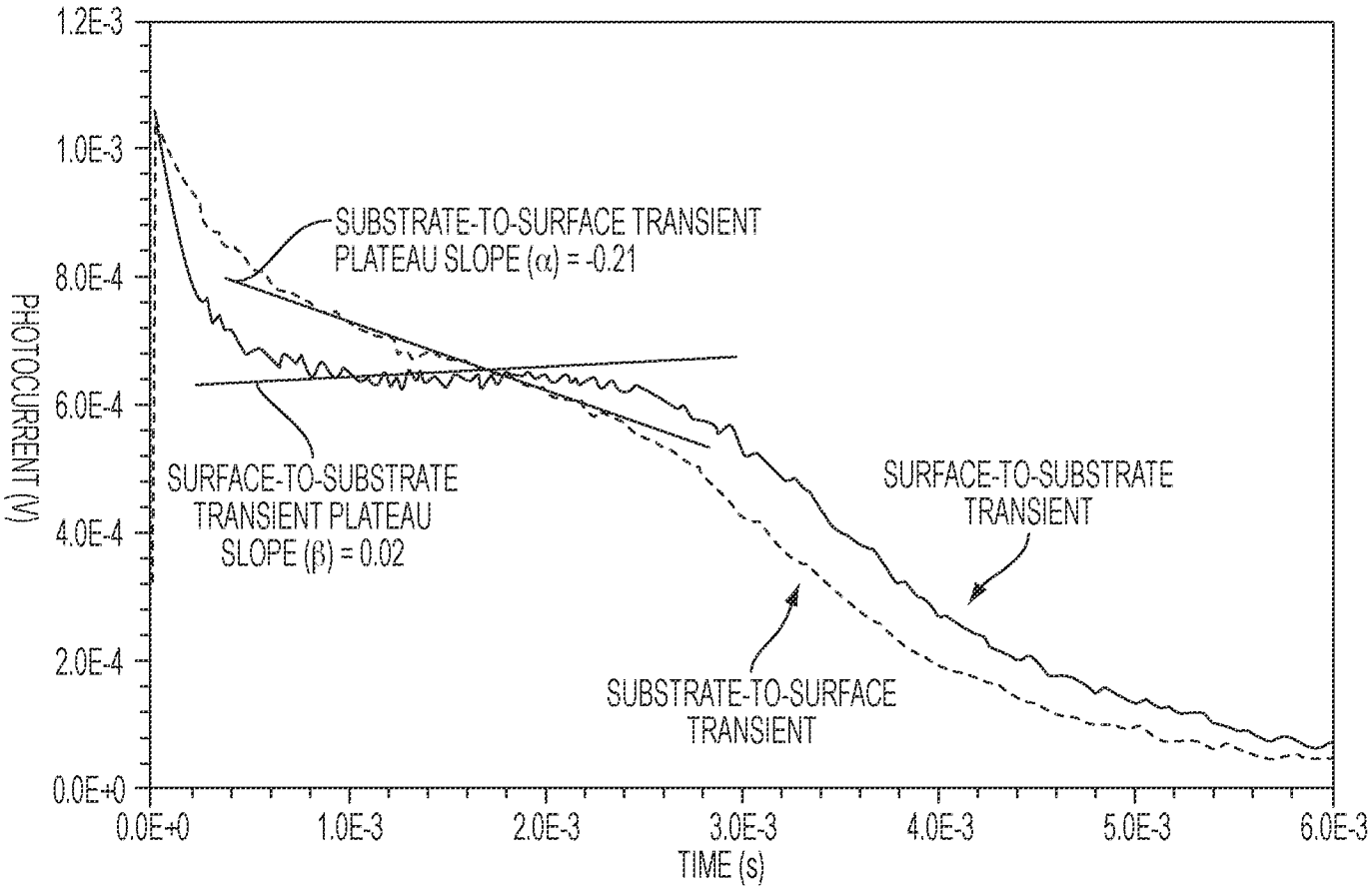
FIG. 4 is a graph illustrating surface-to-substrate versus substrate-to-surface time-of-flight photocurrent transients for a charge transport layer formulated according to the present embodiments, and the designation of the linear regions of the respective transients used in determining their respective slopes.

In the case where there is a gradient in the distribution of the CTM through the thickness of the CTL, then the transient for charge transport from the surface down to the substrate side of the CTL will be different than that for transport from substrate up to the surface. See for example Samples 2, 3, 4, 5, 6, and 7 as shown in FIGS. 3B, 3C, 3D, 3E, 3F, and 3G, respectively. The direction and magnitude of the gradient implied by the difference in the shapes of these transients can be determined by examination of the relative slopes of their plateau regions. Although it is not possible to calculate the absolute CTM concentration gradient by this method, a relative value can be calculated by taking the difference, δ, between the slopes of the respective plateau regions of the surface-to-substrate versus substrate-to-surface time-of-flight photocurrent transients. This δ parameter can then be used to compare the direction and magnitude of the CTM gradient in various samples. Analysis of the slopes of the plateau regions of the surface-to-substrate versus substrate-to-surface time-of-flight photocurrent transients for Sample 2 are illustrated in FIG. 4. The parameter δ is calculated with equation (1).

$$\delta=\alpha-\beta \qquad \text{Equation (1)}$$

Where, α is the slope of the plateau region of the substrate-to-surface transient, and β is the slope of the plateau region of the surface-to-substrate transient. For a CTL with a perfectly homogeneous CTM distribution, the slope in the plateau region of the transient should ideally be flat. However, even when the CTM is evenly distributed in the CTL, under practical conditions, there is the inherent effect of charge trapping that results in a somewhat negatively sloping plateau. In view of the foregoing, a flat or positively sloping (rising) plateau is indicative of acceleration of charge flow in the direction of transport, whereas a plateau that is more negatively sloping (falling) is indicative of deceleration of charge flow in the direction of transport. As such, for charge flow to accelerate the CTM concentration must be increasing through the thickness of the CTL in the direction of transport. Conversely, for charge flow to decelerate the CTM concentration must be decreasing through the thickness of the CTL in the direction of transport.

It should be noted, however, that the concentration gradient does not affect the overall transit time, and hence mobility, through the charge transport layer. The lower mobility of the low concentration region is balanced by the higher mobility of the high concentration region. Table 1 below provides slopes as measured over the plateau region for the transients shown in FIGS. 3A-3G and the resultant δ parameter calculated from these slopes. The greater the difference δ between the substrate-to-surface and surface-to-substrate plateau slopes the greater the magnitude of the CTM gradient through the thickness of the CTL. If the difference δ between the substrate-to-surface and surface-to-substrate plateau slopes is a negative value, then there is a decreasing CTM concentration through the thickness of the CTL from the substrate toward the surface. If the difference δ between the substrate-to-surface and surface-to-substrate plateau slopes is a positive value, then there is an increasing CTM concentration through the thickness of the CTL from the substrate toward the surface. As the difference δ between the plateau slopes approaches zero, so does the CTM concentration gradient through the thickness of the CTL.

TABLE 1

| Samples | Plateau Slope (V/s) | | Plateau Slope Difference [(Substrate- |
|---|---|---|---|
| | Substrate-to-Surface Transient | Surface-to-Substrate Transient | to-Surface) − (Surface-to-Substrate)] (V/s) |
| Sample 1 (FIG. 3A) (PCZ200/ Dichloromethane) | −0.18 | −0.22 | 0.04 |
| Sample 2 (FIG. 3B) (PCZ400/ Dichloromethane) | −0.21 | 0.02 | −0.23 |
| Sample 3 (FIG. 3C) (PCZ800/ Dichloromethane) | −0.42 | 0.29 | −0.71 |
| Sample 4 (FIG. 3D) (Makrolon/ Dichloromethane) | −0.47 | −0.05 | −0.42 |
| Sample 5 (FIG. 3E) (PCZ 200/ Tetrahydrofuran) | −0.22 | −0.50 | 0.28 |
| Sample 6 (FIG. 3F) (PCZ400/ Tetrahydrofuran) | −0.29 | 0.57 | −0.86 |
| Sample 7 (FIG. 3G) (PCZ800/ Tetrahydrofuran) | −0.61 | 0.58 | −1.19 |

As mentioned in the above embodiments there are two variations of the method to measure the CTM gradient in the CTL. In one variation charge is generated directly in the CTL and in the other charge is generated in a neighboring CGL. To demonstrate the latter variation, several different charge transport layer formulations were compared using the method where charge was generated in a neighboring CGL. The results are shown in FIGS. 5A-5H.

Figure 5A:
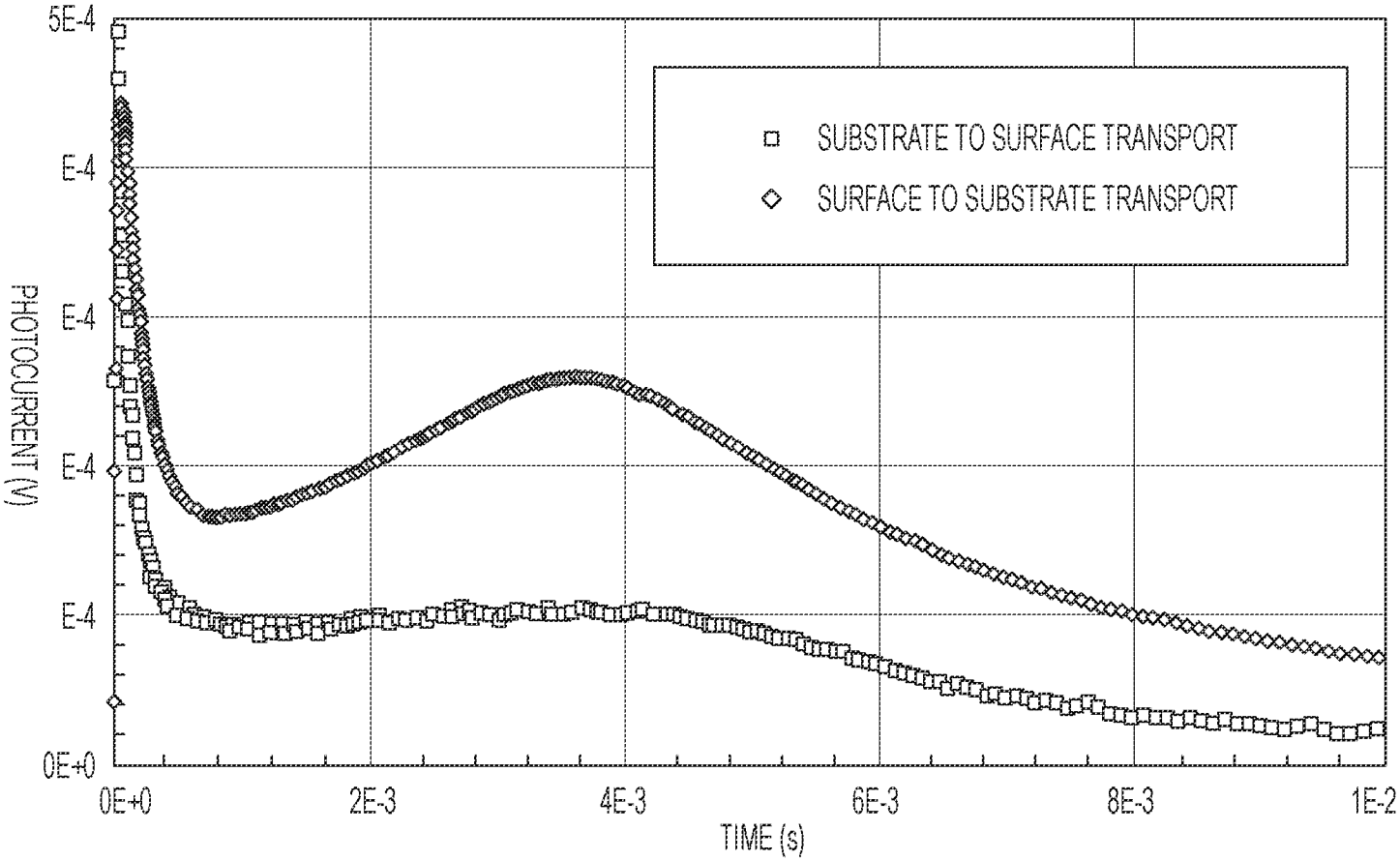
FIG. 5A is a graph illustrating time-of-flight measurements taken where charge was generated in a neighboring CGL for a charge transport layer formulated according to the present embodiments.

FIG. 5A illustrates the time-of-flight measurement of Sample 8, where charge is generated in a CGL neighboring the CTL via 650 nm light pulse for a charge transport layer cast from a solution of 50 wt % TPD and 50 wt % PCZ-200® (MITSUBISHI GAS CHEMICAL COMPANY INC., bisphenol Z polycarbonate having a molecular weight of about 20,000) in dichloromethane having a 40% solids content. The charge transport layer had a thickness of 27 μm and the time-of-flight measurement was performed at an electric field of 10 V/μm.

Figure 5B:
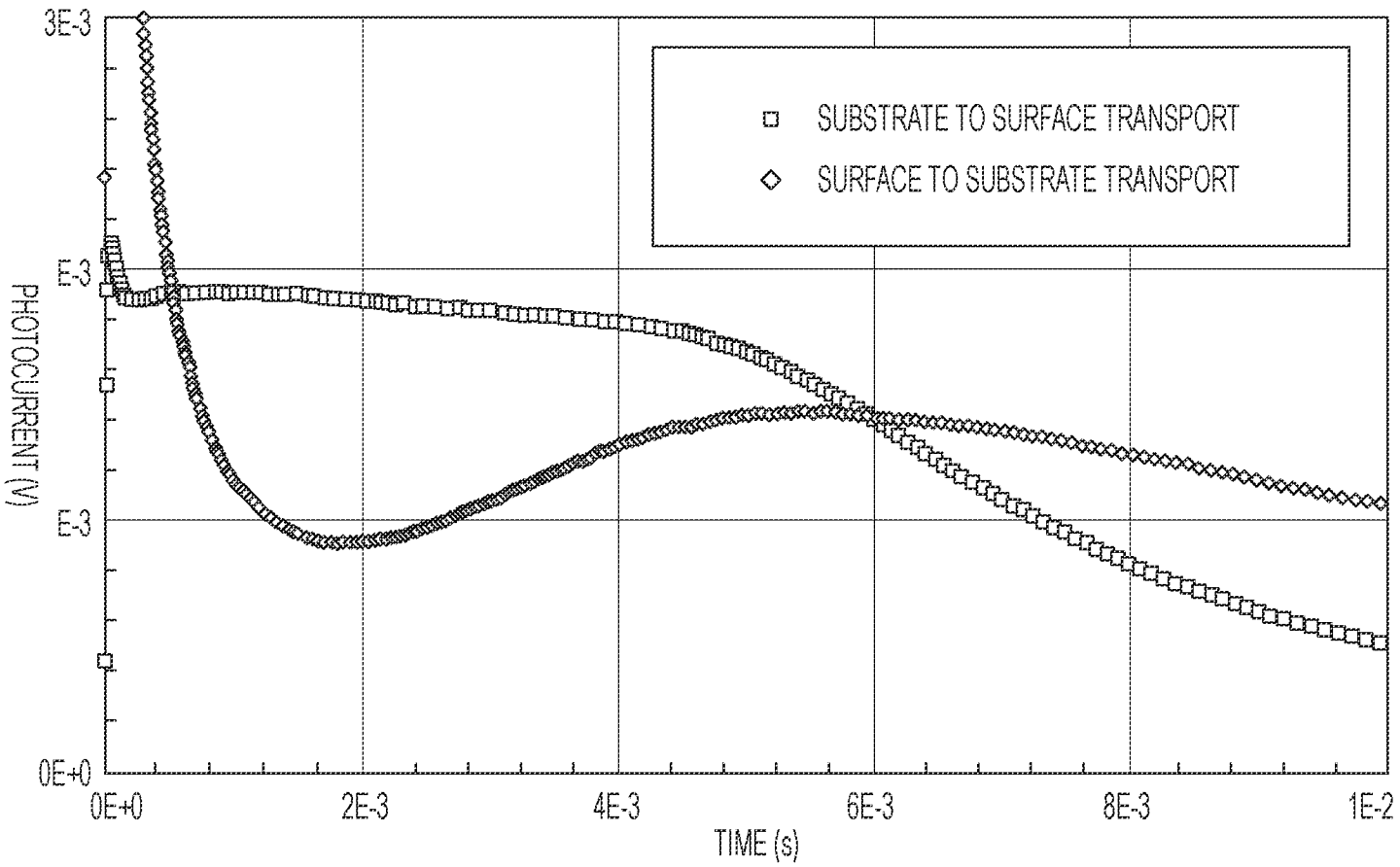
FIG. 5B is a graph illustrating time-of-flight measurements taken where charge was generated in a neighboring CGL for another charge transport layer formulated according to the present embodiments.

FIG. 5B illustrates the time-of-flight measurement of Sample 9, where charge is generated in a CGL neighboring the CTL via 650 nm light pulse for a charge transport layer cast from a solution of 50 wt % TPD and 50 wt % PCZ-400® (MITSUBISHI GAS CHEMICAL COMPANY INC., bisphenol Z polycarbonate having a molecular weight of about 40,000) in dichloromethane having a 28% solids content. The charge transport layer had a thickness of 32 μm and the time-of-flight measurement was performed at an electric field of 10 V/μm.

Figure 5C:
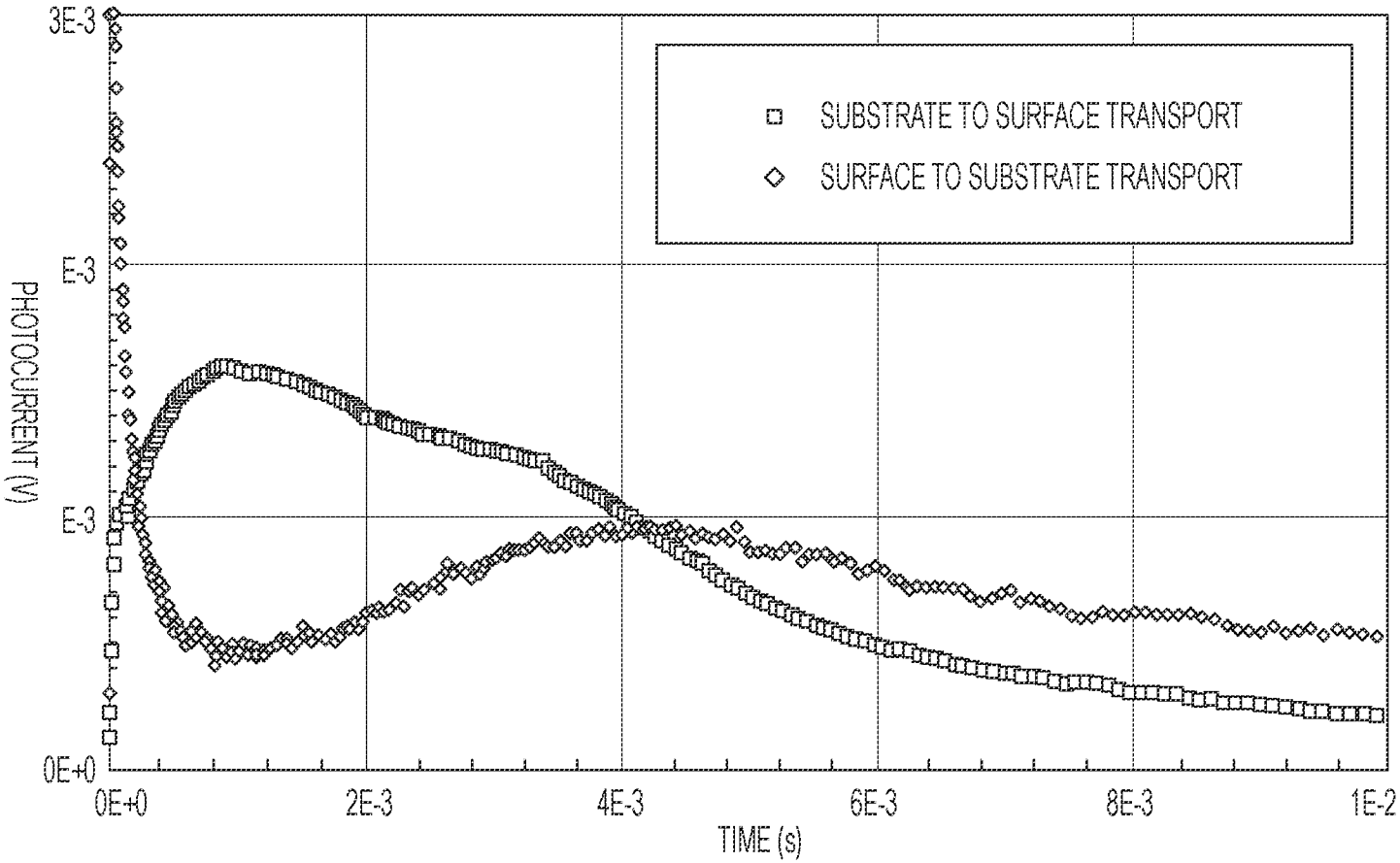
FIG. 5C is a graph illustrating time-of-flight measurements taken where charge was generated in a neighboring CGL for another charge transport layer formulated according to the present embodiments.

FIG. 5C illustrates the time-of-flight measurement of Sample 10, where charge is generated in a CGL neighboring the CTL via 650 nm light pulse for a charge transport layer cast from a solution of 50 wt % TPD and 50 wt % PCZ-800® (MITSUBISHI GAS CHEMICAL COMPANY INC., bisphenol Z polycarbonate having a molecular weight of about 80,000) in dichloromethane having a 17% solids content. The charge transport layer had a thickness of 33 μm and the time-of-flight measurement was performed at an electric field of 10 V/μm.

Figure 5D:
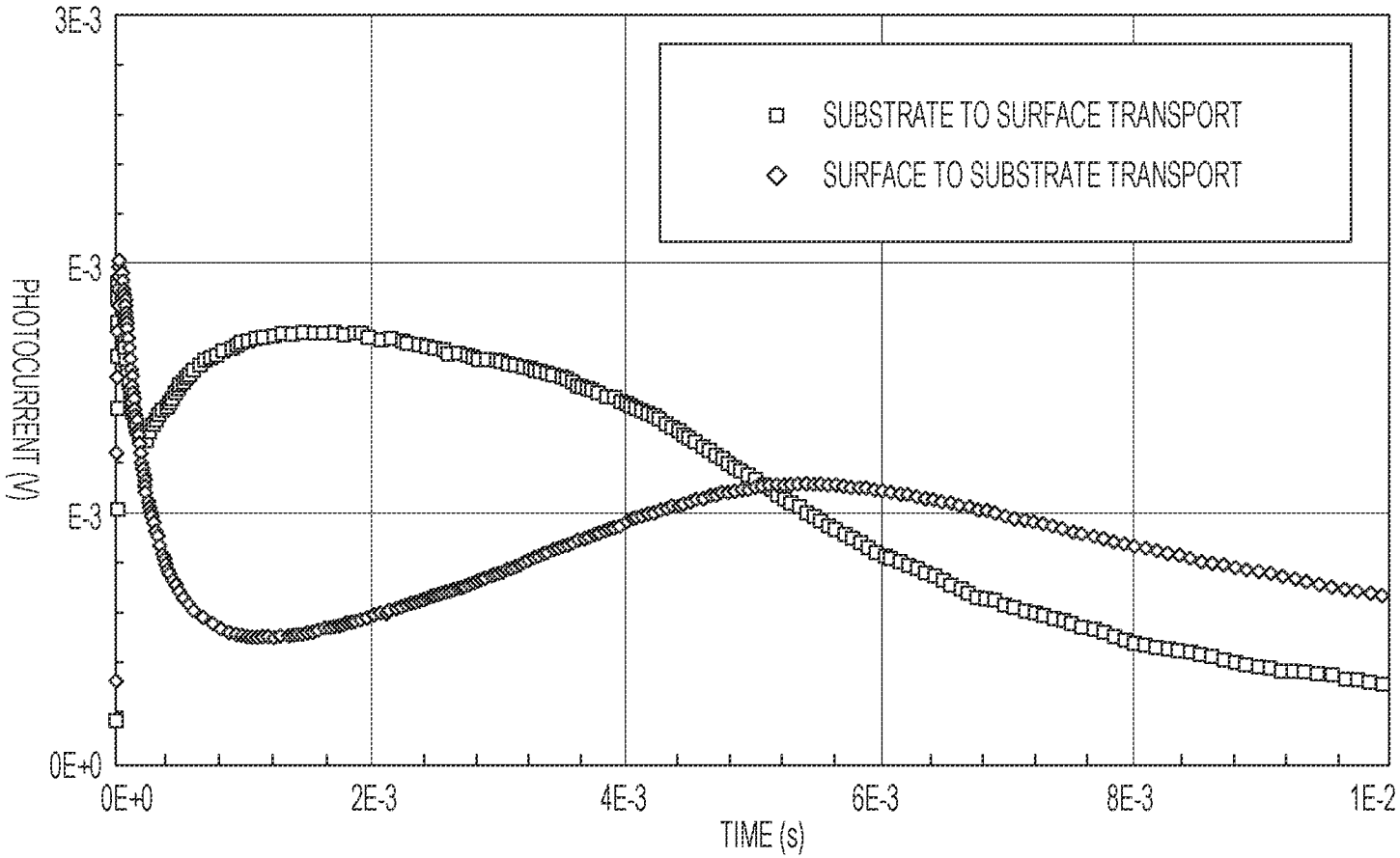
FIG. 5D is a graph illustrating time-of-flight measurements taken where charge was generated in a neighboring CGL for another charge transport layer formulated according to the present embodiments.

FIG. 5D illustrates the time-of-flight measurement of Sample 11, where charge is generated in a CGL neighboring the CTL via 650 nm light pulse for a charge transport layer cast from a solution of 50 wt % TPD and 50 wt % Makrolon 5705® (Farbenfabriken Bayer A.G., bisphenol A polycarbonate having a molecular weight average of from about 50,000 to about 100,000) in dichloromethane having a 17% solids content. The charge transport layer had a thickness of 29 μm and the time-of-flight measurement was performed at an electric field of 10 V/μm.

Figure 5E:
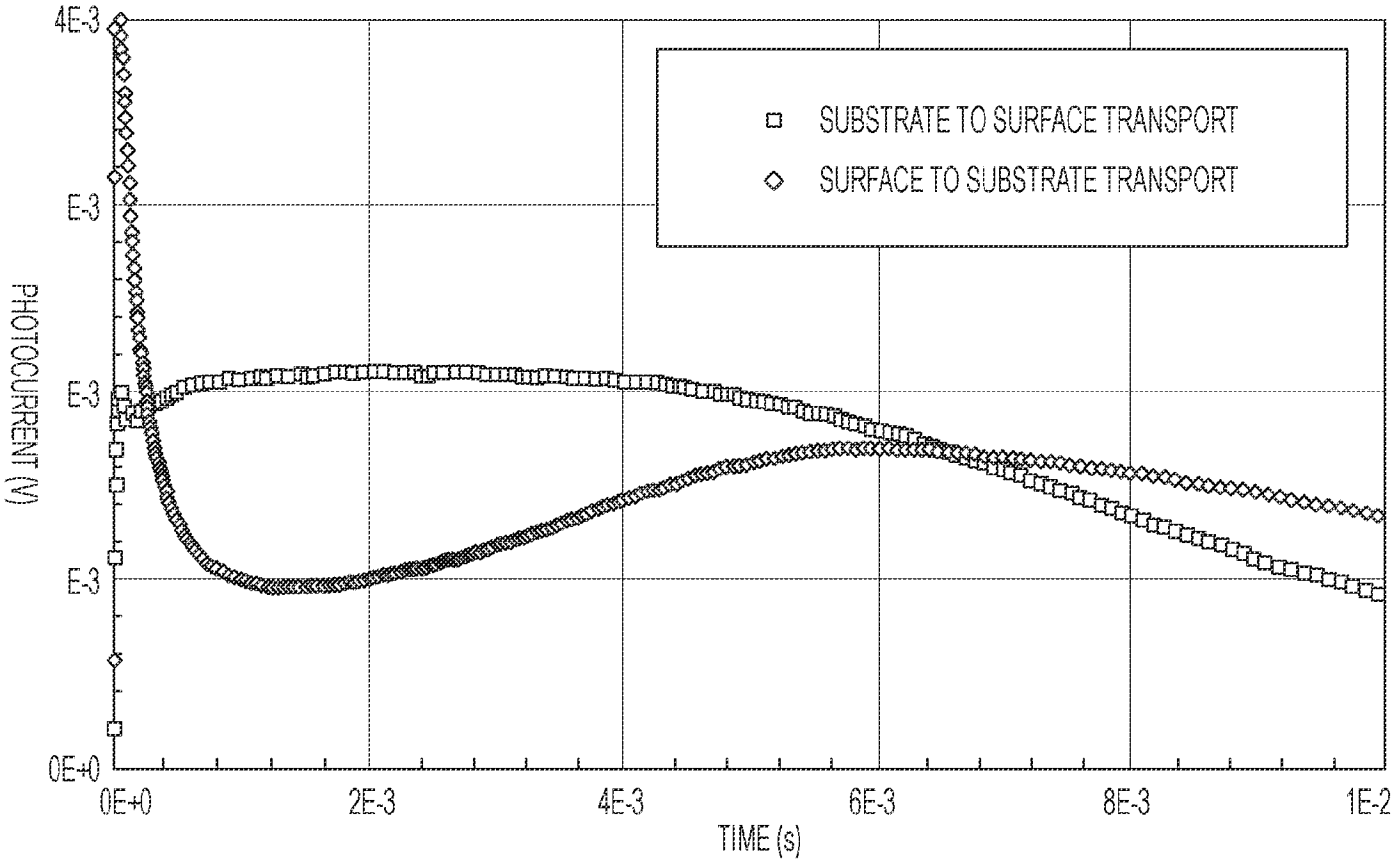
FIG. 5E is a graph illustrating time-of-flight measurements taken where charge was generated in a neighboring CGL for another charge transport layer formulated according to the present embodiments.

FIG. 5E illustrates the time-of-flight measurement of Sample 12, where charge is generated in a CGL neighboring the CTL via 650 nm light pulse for a charge transport layer cast from a solution of 50 wt % TPD and 50 wt % PCZ-200® (MITSUBISHI GAS CHEMICAL COMPANY INC., bisphenol Z polycarbonate having a molecular weight of about 20,000) in tetrahydrofuran having a 44% solids content. The charge transport layer had a thickness of 34 μm and the time-of-flight measurement was performed at an electric field of 10 V/μm.

Figure 5F:
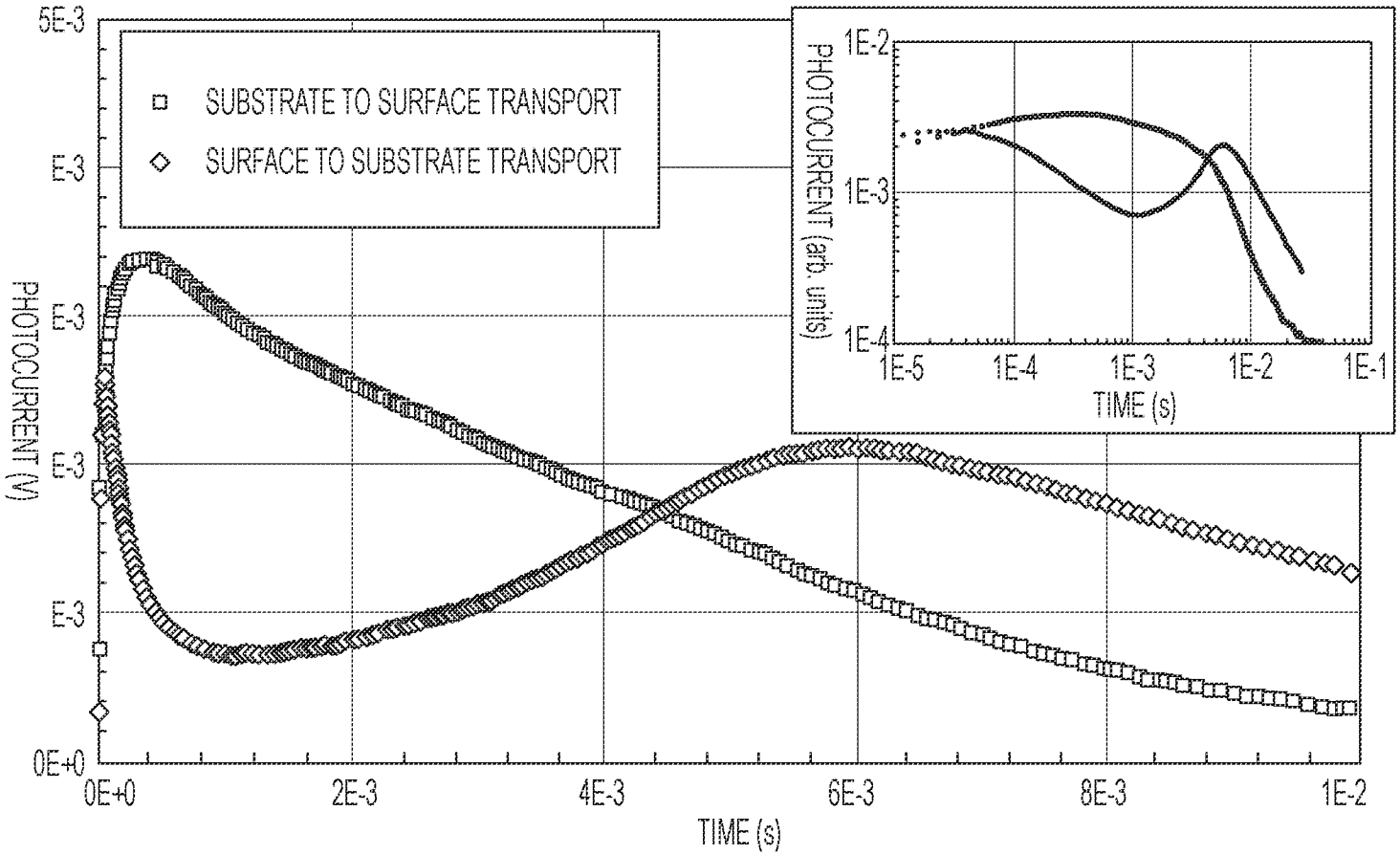
FIG. 5F is a graph illustrating time-of-flight measurements taken where charge was generated in a neighboring CGL for another charge transport layer formulated according to the present embodiments.

FIG. 5F illustrates the time-of-flight measurement of Sample 13, where charge is generated in a CGL neighboring the CTL via 650 nm light pulse for a charge transport layer cast from a solution of 50 wt % TPD and 50 wt % PCZ-400® (MITSUBISHI GAS CHEMICAL COMPANY INC., bisphenol Z polycarbonate having a molecular weight of about 40,000) in tetrahydrofuran having a 34% solids content. The charge transport layer had a thickness of 35 μm and the time-of-flight measurement was performed at an electric field of 10 V/μm.

Figure 5G:
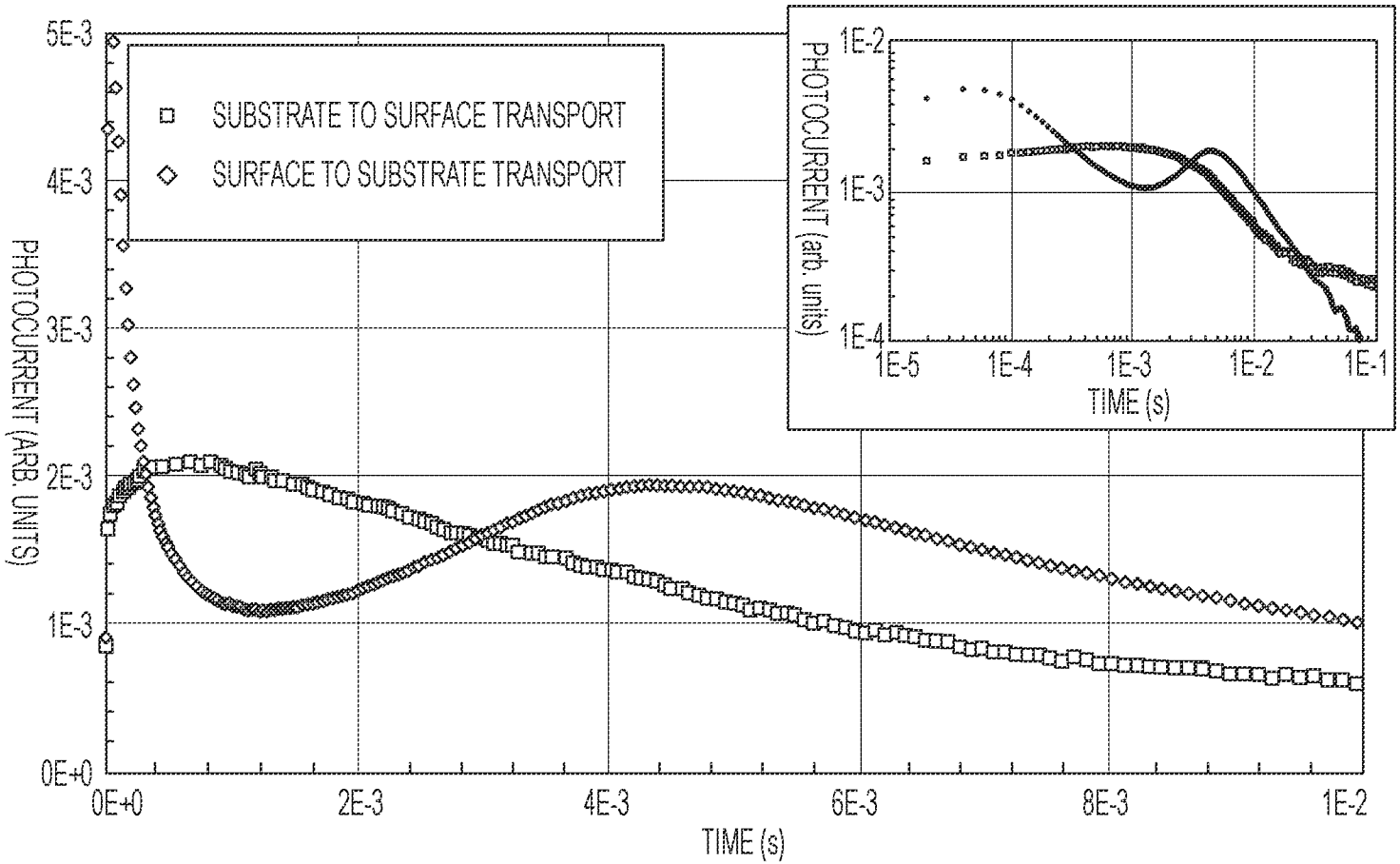
FIG. 5G is a graph illustrating time-of-flight measurements taken where charge was generated in a neighboring CGL for another charge transport layer formulated according to the present embodiments.

FIG. 5G illustrates the time-of-flight measurement of Sample 14 where charge is generated in a CGL neighboring the CTL via 650 nm light pulse for a charge transport layer cast from a solution of 50 wt % TPD and 50 wt % PCZ-800® (MITSUBISHI GAS CHEMICAL COMPANY INC., bisphenol Z polycarbonate having a molecular weight of about 80,000) in tetrahydrofuran having a 24% solids content. The charge transport layer had a thickness of 29 μm and the time-of-flight measurement was performed at an electric field of 10 V/μm.

Figure 5H:
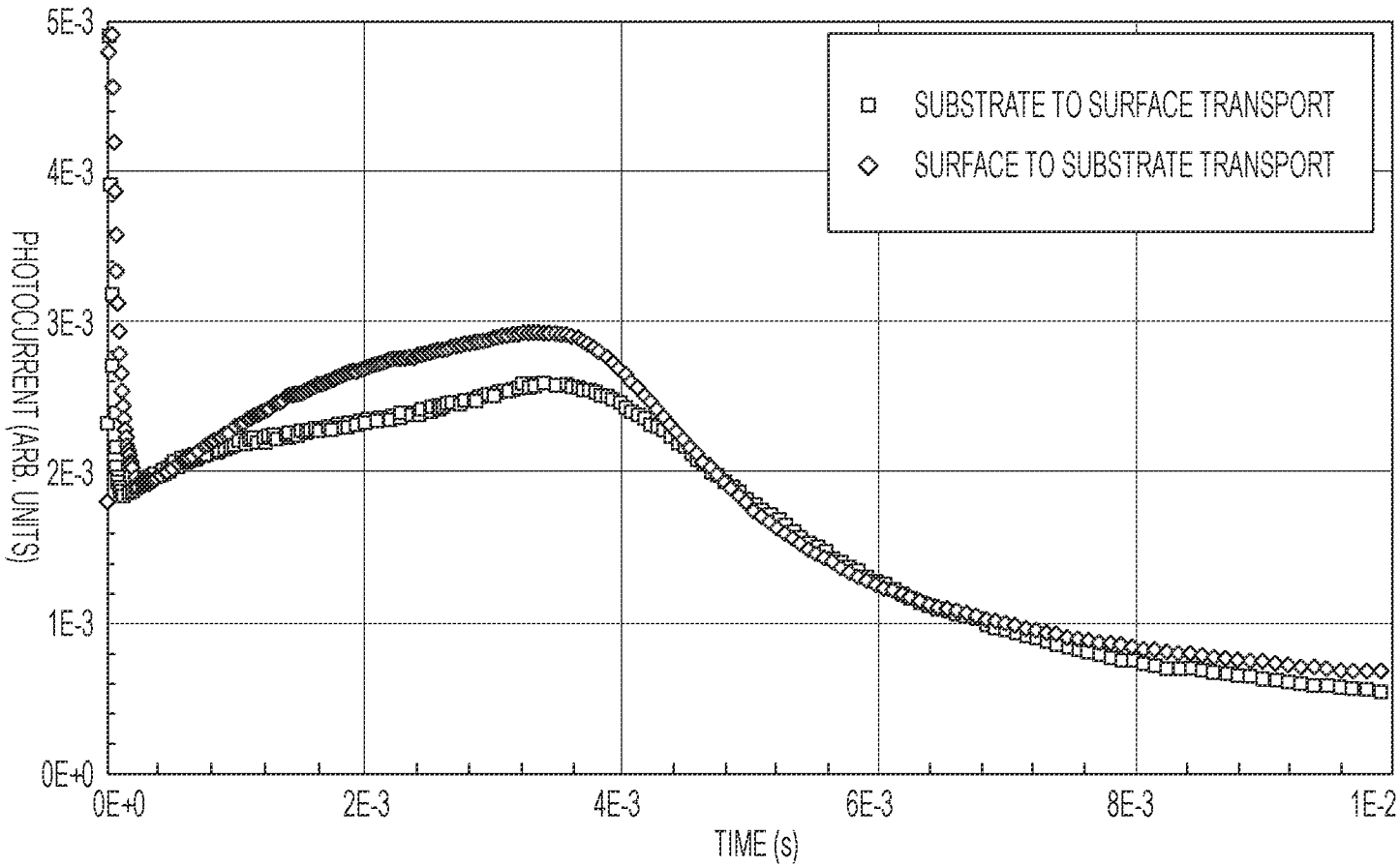
FIG. 5H is a graph illustrating time-of-flight measurements taken where charge was generated in a neighboring CGL for a comparative charge transport layer.
Figure 6A:
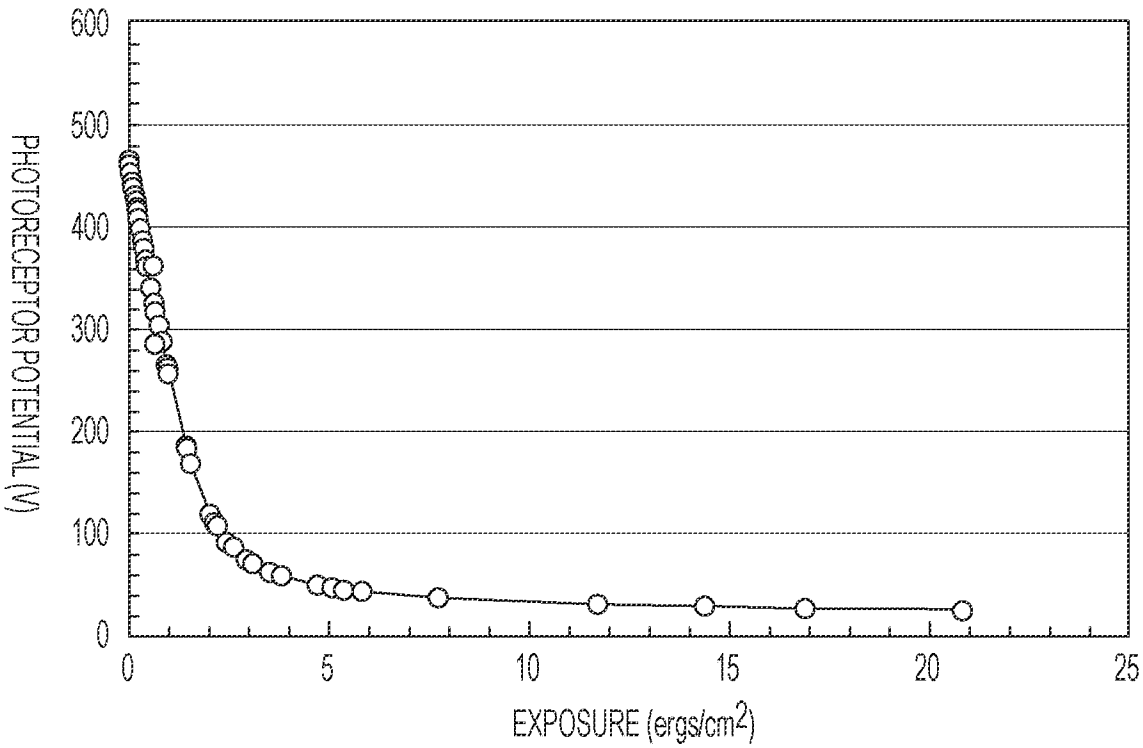
FIG. 6A is a graph illustrating the photoinduced discharge characteristic curves (PIDC) measurements performed on sample devices with the charge transport layer formulated according to the present embodiments.
Figure 6B:
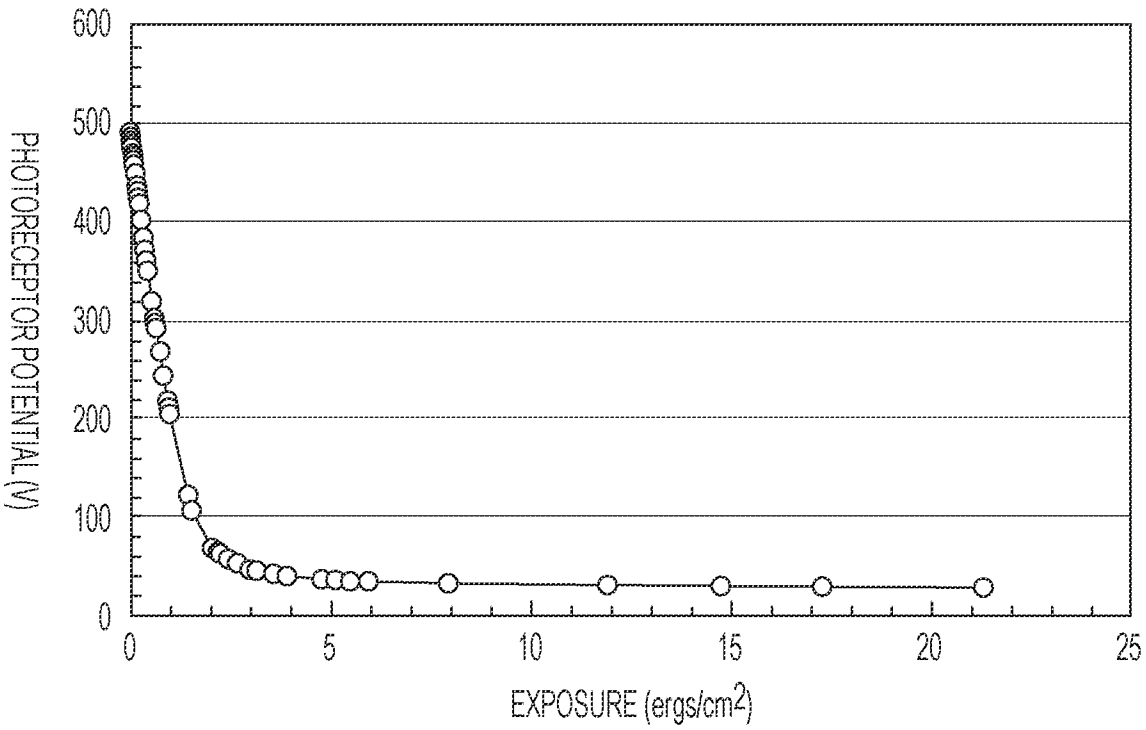
FIG. 6B is a graph illustrating the photoinduced discharge characteristic curves (PIDC) measurements performed on sample devices with the charge transport layer formulated according to the present embodiments.
Figure 6C:
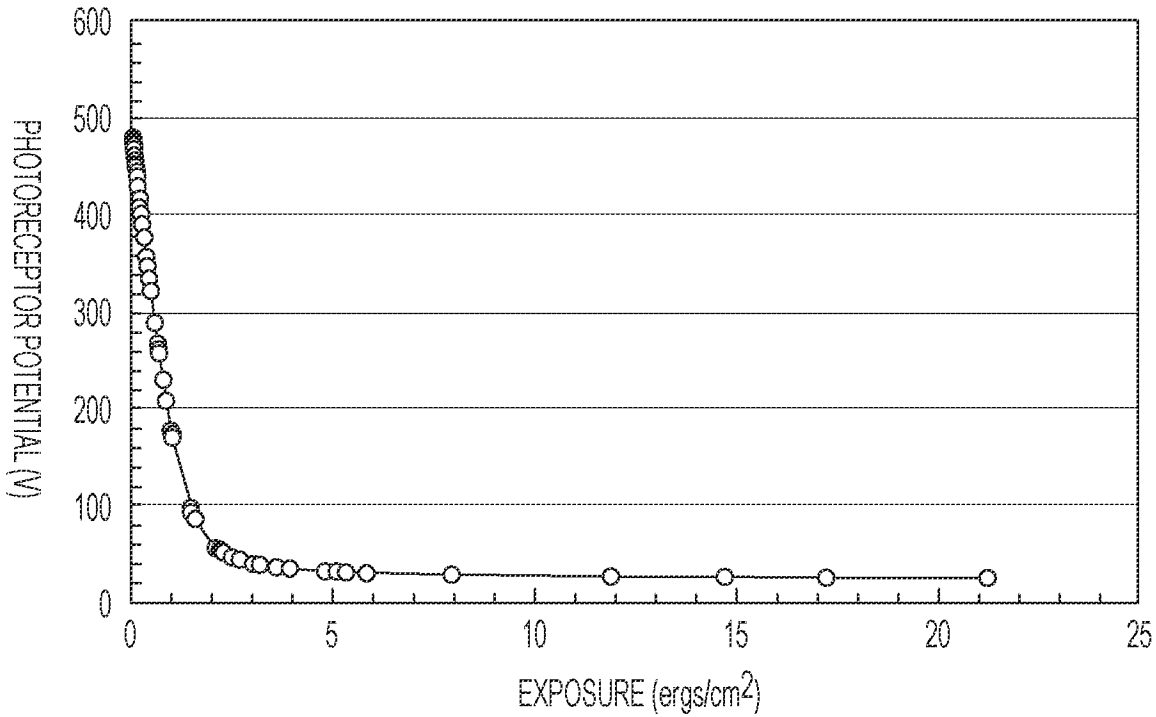
FIG. 6C is a graph illustrating the photoinduced discharge characteristic curves (PIDC) measurements performed on sample devices with the charge transport layer formulated according to the present embodiments.
Figure 6D:
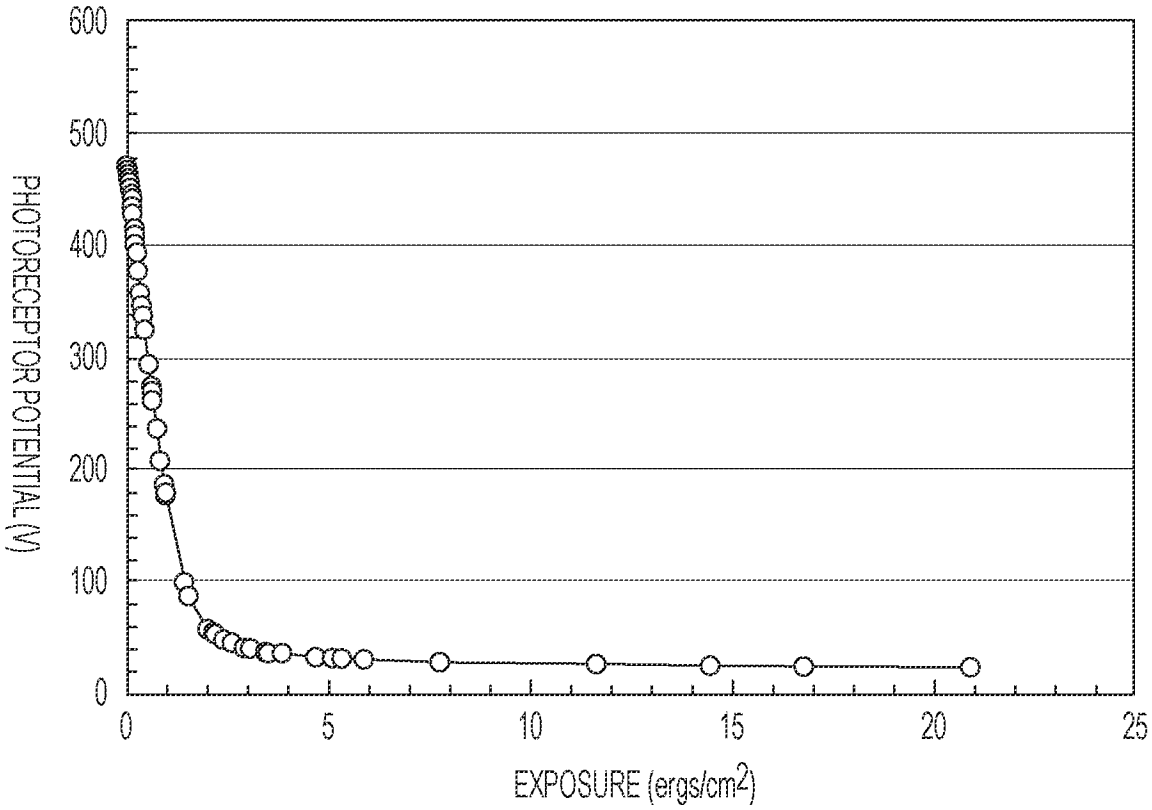
FIG. 6D is a graph illustrating the photoinduced discharge characteristic curves (PIDC) measurements performed on sample devices with the charge transport layer formulated according to the present embodiments.
Figure 6E:
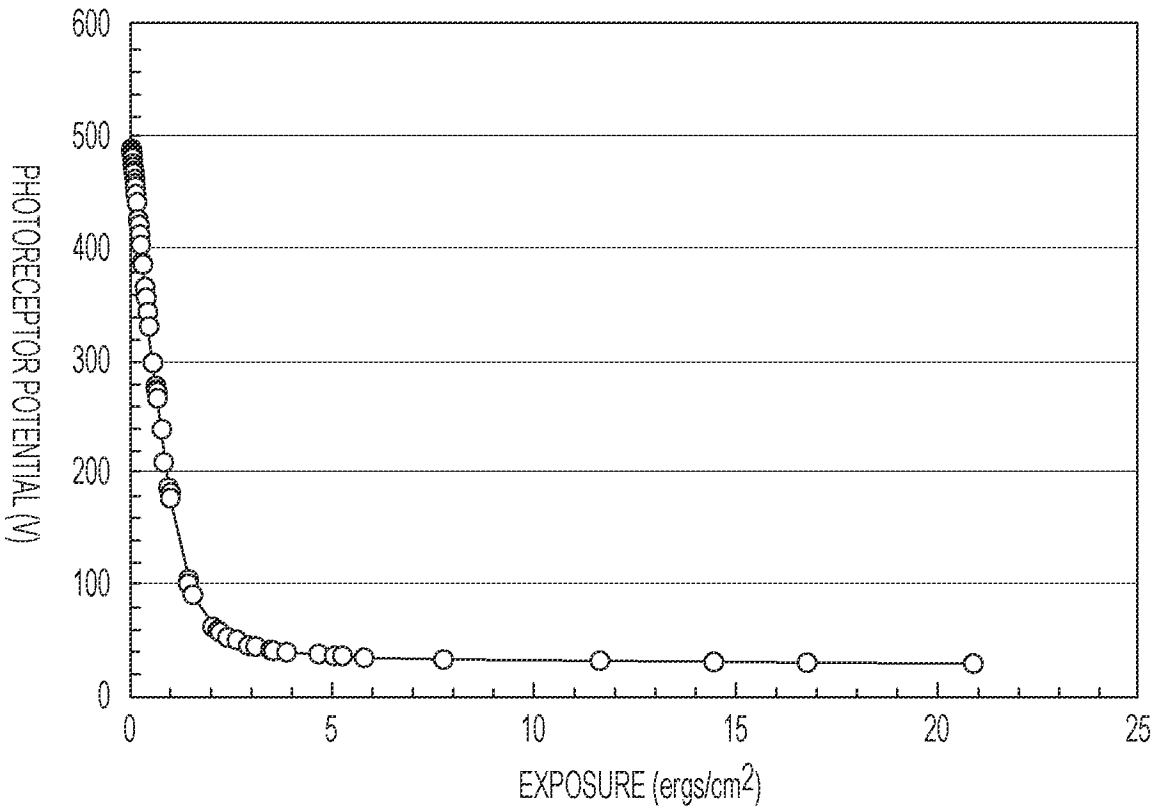
FIG. 6E is a graph illustrating the photoinduced discharge characteristic curves (PIDC) measurements performed on sample devices with the charge transport layer formulated according to the present embodiments.
Figure 6F:
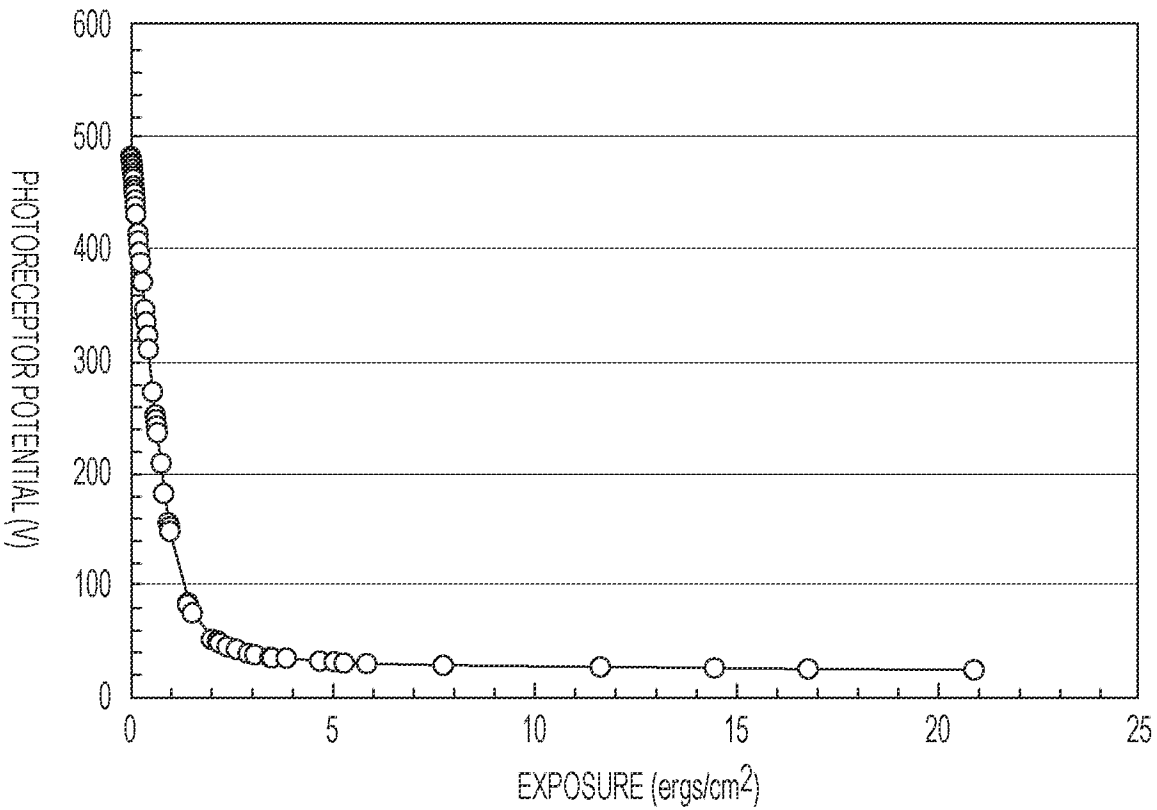
FIG. 6F is a graph illustrating the photoinduced discharge characteristic curves (PIDC) measurements performed on sample devices with the charge transport layer formulated according to the present embodiments.
Figure 6G:
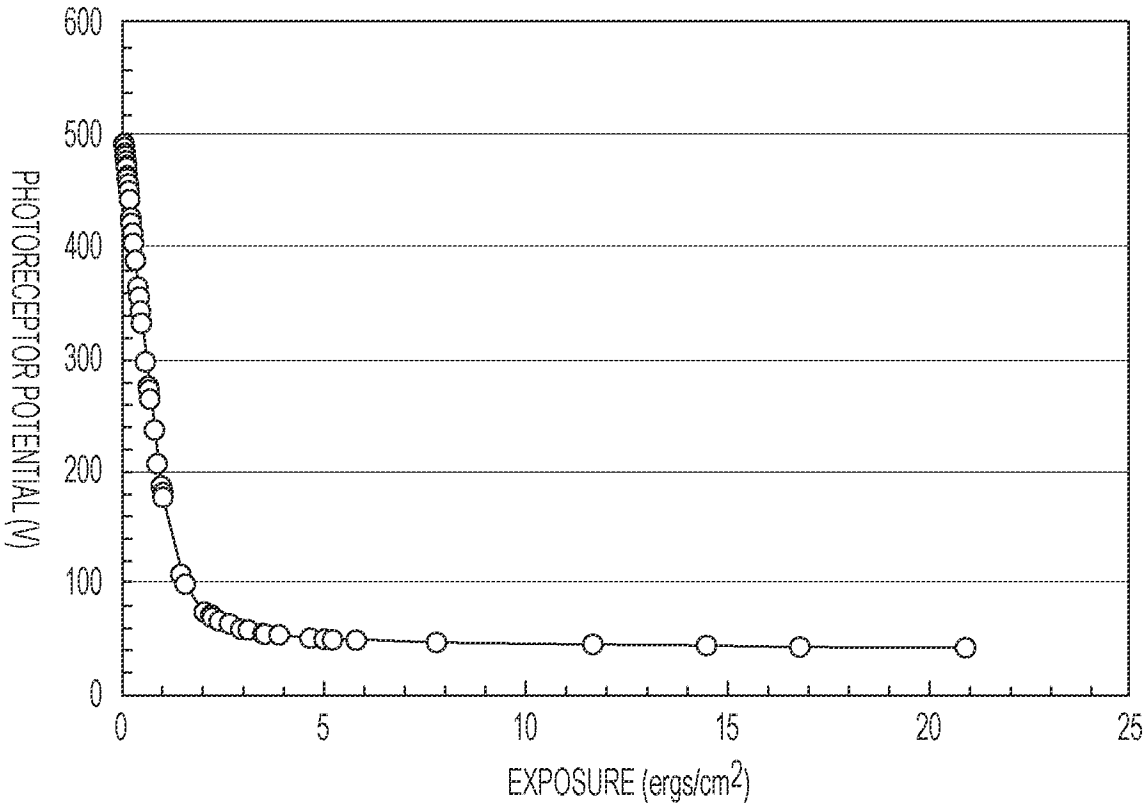
FIG. 6G is a graph illustrating the photoinduced discharge characteristic curves (PIDC) measurements performed on sample devices with the charge transport layer formulated according to the present embodiments.
Figure 6H:
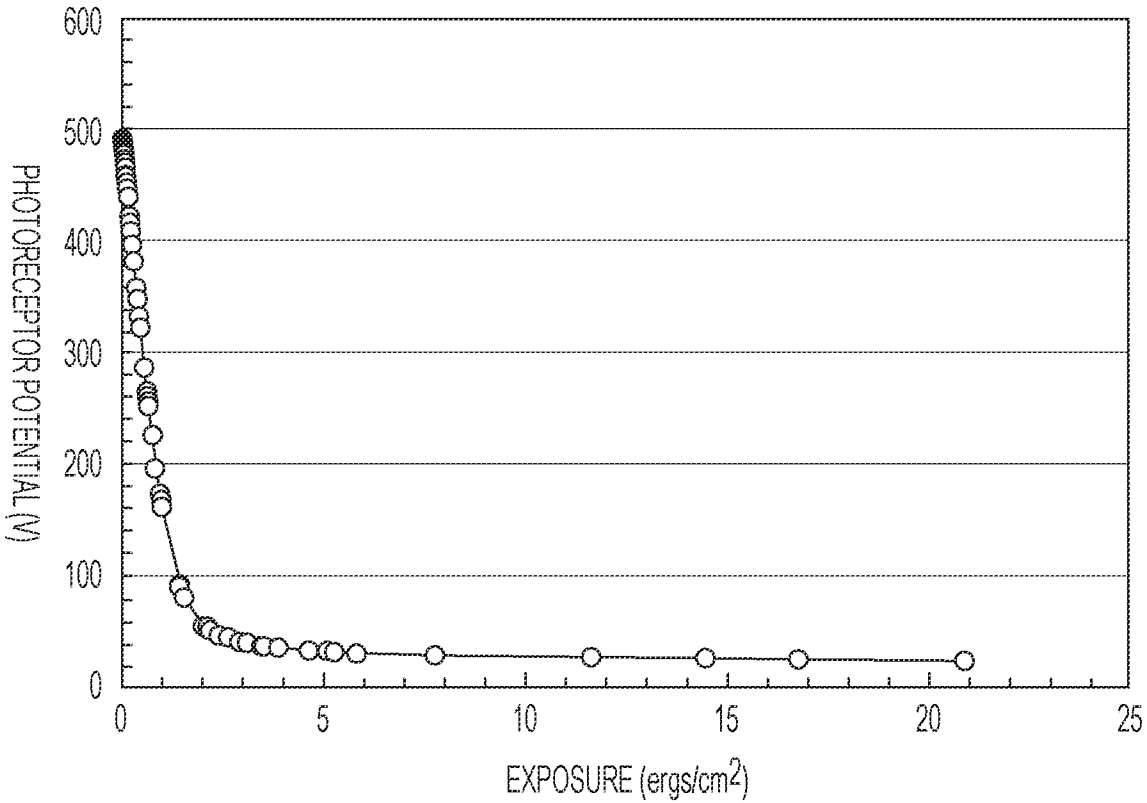
FIG. 6H is a graph illustrating the photoinduced discharge characteristic curves (PIDC) measurements performed on sample devices with the charge transport layer formulated according to the present embodiments.

FIG. 5H illustrates the time-of-flight measurement of a commercially available photoreceptor (XEROX® Nuvera® production photoreceptor) where charge is generated in a CGL neighboring the CTL via 650 nm light pulse. The charge transport layer had a thickness of about 30 μm and the time-of-flight measurement was performed at an electric field of 10 V/μm.

Table 2 below provides slopes as measured over the plateau region for the transients shown in FIGS. 5A-5H and the resultant δ parameter calculated from these slopes.

TABLE 2

| Samples | Plateau Slope (V/s) | | Plateau Slope Difference □ [(Substrate- |
|---|---|---|---|
| | Substrate-to-Surface Transient | Surface-to-Substrate Transient | to-Surface) − (Surface-to-Substrate)] (V/s) |
| Sample 8 (FIG. 5A) (PCZ200/ Dichloromethane) | 0.14 | 0.28 | −0.14 |

TABLE 2-continued

| Samples | Plateau Slope (V/s) | | Plateau Slope Difference □ [(Substrate- |
|---|---|---|---|
| | Substrate-to-Surface Transient | Surface-to-Substrate Transient | to-Surface) − (Surface-to-Substrate)] (V/s) |
| Sample 9 (FIG. 5B) (PCZ400/ Dichloromethane) | −0.01 | 0.57 | −0.49 |
| Sample 10 (FIG. 5C) (PCZ800/ Dichloromethane) | −0.28 | 0.73 | −1.01 |
| Sample 11 (FIG. 5D) (Makrolon/ Dichloromethane) | 0.08 | 0.79 | −0.71 |
| Sample 12 (FIG. 5E) (PCZ 200/ Tetrahydrofuran) | 0.03 | 0.61 | −0.58 |
| Sample 13 (FIG. 5F) (PCZ400/ Tetrahydrofuran) | −0.25 | 0.84 | −1.09 |
| Sample 14 (FIG. 5G) (PCZ800/ Tetrahydrofuran) | −0.23 | 0.75 | −0.98 |
| Sample 15 (FIG. 5H) Nuvera Production Photoreceptor | 0.09 | 0.23 | −0.14 |

The charge transport layer in embodiments can further comprise suitable additives, such as at least one additional binder polymer, such as from 1 to about 5 polymers, at least one additional hole transport molecule, such as from 1 to about 7, 1 to about 4, or from 1 to about 2 antioxidants like IRGANOX®, and the like. The thickness of the photoreceptor substrate layer depends on many factors, including economical considerations, electrical characteristics, and the like, thus this layer may be of substantial thickness, for example over 3,000 microns, such as from about 300 to about 1,000 microns, or of a minimum thickness. In embodiments, the thickness of this layer is from about 75 microns to about 300 microns, or from about 100 microns to about 150 microns.

The substrate, which may be opaque or substantially transparent, may comprise a number of suitable materials, inclusive of known photoreceptor supporting substrate, and wherein the substrate is usually in contact with and contiguous to the photogenerating layer. Accordingly, the substrate may comprise a layer of an electrically nonconductive or conductive material such as an inorganic or an organic composition. As electrically nonconducting materials, there may be selected a number of various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, a layer of an organic or inorganic material having a conductive surface layer, such as indium tin oxide, or aluminum arranged thereon, or a conductive material inclusive of aluminum, chromium, nickel, titanium, zirconium, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt.

Hole blocking or undercoat layers for the imaging members of the present disclosure can contain a number of components including known hole blocking components, such as amino silanes, doped metal oxides, TiSi, a metal oxide of titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™

29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene) bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Borden Chemical).

In embodiments, a suitable adhesive layer can be included in the photoreceptor. Typical adhesive layer materials are, for example, polyesters, polyurethanes, copolyesters, polyamides, poly(vinyl butyral), poly(vinyl alcohol), polyurethanes, polyacrylonitriles, and the like. The adhesive layer thickness can vary and in embodiments is, for example, from about 0.05 micrometer to about 0.3 micrometer. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The photogenerating layer in embodiments is comprised of, for example, about 60 weight percent of Type V hydroxygallium phthalocyanine or chlorogallium phthalocyanine, and about 40 weight percent of a resin binder like poly(vinyl chloride-co-vinyl acetate)copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed, in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 2 microns, and more specifically, from about 0.25 micron to about 1 micron when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates; copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon, and compounds of silicon and germanium, carbon, oxygen, nitrogen and the like fabricated by vacuum evaporation or deposition. The photogenerating layer may also comprise inorganic pigments of crystalline selenium and its alloys; Group II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines can be selected as photogenerating materials or pigments, especially when the photoreceptor is incorporated in laser printers using infrared exposure systems. Infrared sensitivity is usually desired for photoreceptors exposed to low-cost semiconductor laser diode light exposure devices. The absorption spectrum and photosensitivity of the phthalocyanines depend on the central metal atom of the compound. Many metal phthalocyanines have been reported that are suitable, such as oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine.

In embodiments, examples of polymeric binder materials that can be selected for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride, and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating may be performed such that the final dry thickness of the photogenerating layer is as illustrated herein, and can be, for example, from about 0.01 to about 2 microns after being dried at, for example, about 40° C. to about 150° C. for about 15 minutes to about 90 minutes. More specifically, a photogenerating layer of a thickness, for example, of from about 0.1 to about 1 micron, or from about 0.3 to about 0.8 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

Examples of the binder materials selected for the charge transport layer include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight M w of from about 50,000 to about 100,000 preferred. Generally, the transport layer contains from about 10 to about 75 percent by weight of the charge transport material, and more specifically, from about 35 percent to about 50 percent of this material.

The charge transport layer, may comprise the charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. In embodiments, charge transport molecule refers, for example, to charge transporting molecules as a monomer that allows the free charge generated in the photogenerating layer to be transported across the transport layer.

A number of processes may be used to mix and thereafter apply the charge transport layer coating mixture to the photogenerating layer. Typical application techniques include spraying, dip coating, roll coating, wire wound rod coating, and the like. Drying of the deposited charge transport layer coating may be effected by any suitable conventional technique such as oven drying, infrared radiation drying, air drying, and the like.

Examples of components or materials optionally incorporated into the charge transport layer to, for example, enable improved lateral charge migration (LCM) resistance include hindered phenolic antioxidants, such as tetrakis methylene(3,5-di-tert-butyl-4-hydroxy hydrocinnamate)methane (IRGANOX 1010™ available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40 AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethyl-aminophenyl)]-phen ylmethane (DHTPM), and the like. The weight percent of the antioxidant in at least one of the charge transport layers is from about 0 to about 20, from about 1 to about 10, or from about 3 to about 8 weight percent.

At least one, especially as it is applicable to the charge transport layer, refers, for example, to 1; to from 1 to about 7; from 1 to about 4; from 1 to about 3, and yet more specifically, to 2 layers.

Other layers may include an anti-curl back coating layer. The anti-curl back coating may comprise organic polymers or inorganic polymers that are electrically insulating or slightly semi-conductive. The anti-curl back coating provides flatness and/or abrasion resistance.

The anti-curl back coating may be formed at the back side of the substrate, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below are illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

A sample device was fabricated in accordance with the following procedure. A charge transport layer was prepared by introducing into a 30 mL amber glass bottle 1 part high quality TPD and 1 part PCZ-200®, a known polycarbonate resin having a molecular weight average of about 20,000, commercially available from Mitsubishi Gas Chemical Inc. The resulting mixture was then dissolved in methylene chloride to form a solution containing 27 percent solids by weight. The solution was then blade-coated by hand onto a NUVERA® production base electrode substrate (photoreceptor minus the charge generation and charge transport layers), consisting of an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 2

A sample device was fabricated in accordance with the following procedure. A charge transport layer was prepared by introducing into a 30 mL amber glass bottle 1 part high quality TPD and 1 part PCZ-400®, a known polycarbonate resin having a molecular weight average of about 40,000, commercially available from Mitsubishi Gas Chemical Inc. The resulting mixture was then dissolved in methylene chloride to form a solution containing 28 percent solids by weight. The solution was then blade-coated by hand onto a NUVERA® production base electrode substrate (photoreceptor minus the charge generation and charge transport layers), consisting of an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 3

A sample device was fabricated in accordance with the following procedure. A charge transport layer was prepared by introducing into a 30 mL amber glass bottle 1 part high quality TPD and 1 part PCZ-800®, a known polycarbonate resin having a molecular weight average of about 80,000, commercially available from Mitsubishi Gas Chemical Inc. The resulting mixture was then dissolved in methylene chloride to form a solution containing 17 percent solids by weight. The solution was then blade-coated by hand onto a NUVERA® production base electrode substrate (photoreceptor minus the charge generation and charge transport layers), consisting of an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 4

A sample device was fabricated in accordance with the following procedure. A charge transport layer was prepared by introducing into a 30 mL amber glass bottle 1 part high quality TPD and 1 part MAKROLON 5750®, a known polycarbonate resin having a molecular weight average of from about 50,000 to 100,000, commercially available from Farbenfabriken Bary A.G. The resulting mixture was then dissolved in methylene chloride to form a solution containing 17 percent solids by weight. The solution was then blade-coated by hand onto a NUVERA® production base electrode substrate (photoreceptor minus the charge generation and charge transport layers), consisting of an adhesive layer, a hole blocking layer, and a metal ground electrode layer on a poly (ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 5

A sample device was fabricated in accordance with the following procedure. A charge transport layer was prepared by introducing into a 30 mL amber glass bottle 1 part high quality TPD and 1 part PCZ-200®, a known polycarbonate resin having a molecular weight average of about 20,000, commercially available from Mitsubishi Gas Chemical Inc. The resulting mixture was then dissolved in tetrahydrofuran to form a solution containing 44 percent solids by weight. The solution was then blade-coated by hand onto a NUVERA® production base electrode substrate (photoreceptor minus the charge generation and charge transport layers), consisting of an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 6

A sample device was fabricated in accordance with the following procedure. A charge transport layer was prepared by introducing into a 30 mL amber glass bottle 1 part high quality TPD and 1 part PCZ-4000, a known polycarbonate resin having a molecular weight average of about 40,000, commercially available from Mitsubishi Gas Chemical Inc. The resulting mixture was then dissolved in tetrahydrofuran to form a solution containing 34 percent solids by weight. The solution was then blade-coated by hand onto a NUVERA® production base electrode substrate (photoreceptor minus the charge generation and charge transport layers), consisting of an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 7

A sample device was fabricated in accordance with the following procedure. A charge transport layer was prepared by introducing into a 30 mL amber glass bottle 1 part high quality TPD and 1 part PCZ-800®, a known polycarbonate resin having a molecular weight average of about 80,000, commercially available from Mitsubishi Gas Chemical Inc. The resulting mixture was then dissolved in tetrahydrofuran to form a solution containing 24 percent solids by weight. The solution was then blade-coated by hand onto a NUVERA® production base electrode substrate (photoreceptor minus the charge generation and charge transport layers), consisting of an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 8

A sample device was fabricated in accordance with the following procedure. A charge transport layer was prepared by introducing into a 30 mL amber glass bottle 1 part high quality TPD and 1 part PCZ-200®, a known polycarbonate resin having a molecular weight average of about 20,000, commercially available from Mitsubishi Gas Chemical Inc. The resulting mixture was then dissolved in methylene chloride to form a solution containing 27 percent solids by weight. The solution was then blade-coated by hand onto a NUVERA® production base charge generation layer substrate (photoreceptor minus the charge transport layer), consisting of a charge generation layer, an adhesive layer, a hole blocking layer, and a metal ground electrode layer on a poly (ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 9

A sample device was fabricated in accordance with the following procedure. A charge transport layer was prepared by introducing into a 30 mL amber glass bottle 1 part high quality TPD and 1 part PCZ-400®, a known polycarbonate resin having a molecular weight average of about 40,000, commercially available from Mitsubishi Gas Chemical Inc. The resulting mixture was then dissolved in methylene chloride to form a solution containing 28 percent solids by weight. The solution was then blade-coated by hand onto a NUVERA® production base charge generation layer substrate (photoreceptor minus the charge transport layer), consisting of a charge generation layer, an adhesive layer, a hole blocking layer, and a metal ground electrode layer on a poly (ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 10

A sample device was fabricated in accordance with the following procedure. A charge transport layer was prepared by introducing into a 30 mL amber glass bottle 1 part high quality TPD and 1 part PCZ-800®, a known polycarbonate resin having a molecular weight average of about 80,000, commercially available from Mitsubishi Gas Chemical Inc. The resulting mixture was then dissolved in methylene chloride to form a solution containing 17 percent solids by weight. The solution was then blade-coated by hand onto a NUVERA® production base charge generation layer substrate (photoreceptor minus the charge transport layer), consisting of a charge generation layer, an adhesive layer, a hole blocking layer, and a metal ground electrode layer on a poly (ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 11

A sample device was fabricated in accordance with the following procedure. A charge transport layer was prepared by introducing into a 30 mL amber glass bottle 1 part high quality TPD and 1 part MAKROLON 5750®, a known polycarbonate resin having a molecular weight average of from about 50,000 to 100,000, commercially available from Farbenfabriken Bary A.G. The resulting mixture was then dissolved in methylene chloride to form a solution containing 17 percent solids by weight. The solution was then blade-coated by hand onto a NUVERA® production base charge generation layer substrate (photoreceptor minus the charge transport layer), consisting of a charge generation layer, an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 12

A sample device was fabricated in accordance with the following procedure. A charge transport layer was prepared by introducing into a 30 mL amber glass bottle 1 part high quality TPD and 1 part PCZ-200®, a known polycarbonate resin having a molecular weight average of about 20,000, commercially available from Mitsubishi Gas Chemical Inc. The resulting mixture was then dissolved in tetrahydrofuran to form a solution containing 44 percent solids by weight. The solution was then blade-coated by hand onto a NUVERA® production base charge generation layer substrate (photoreceptor minus the charge transport layer), consisting of a charge generation layer, an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 13

A sample device was fabricated in accordance with the following procedure. A charge transport layer was prepared by introducing into a 30 mL amber glass bottle 1 part high quality TPD and 1 part PCZ-400®, a known polycarbonate resin having a molecular weight average of about 40,000, commercially available from Mitsubishi Gas Chemical Inc.

The resulting mixture was then dissolved in tetrahydrofuran to form a solution containing 34 percent solids by weight. The solution was then blade-coated by hand onto a NUVERA® production base charge generation layer substrate (photoreceptor minus the charge transport layer), consisting of a charge generation layer, an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Example 14

A sample device was fabricated in accordance with the following procedure. A charge transport layer was prepared by introducing into a 30 mL amber glass bottle 1 part high quality TPD and 1 part PCZ-800®, a known polycarbonate resin having a molecular weight average of about 80,000, commercially available from Mitsubishi Gas Chemical Inc. The resulting mixture was then dissolved in tetrahydrofuran to form a solution containing 24 percent solids by weight. The solution was then blade-coated by hand onto a NUVERA® production base charge generation layer substrate (photoreceptor minus the charge transport layer), consisting of a charge generation layer, an adhesive layer, a hole blocking layer, and a metal ground electrode layer on a poly(ethylene naphthalate) (PEN) substrate, to form a charge transport layer coating that upon drying had a thickness of about 30 microns. The cast film was allowed to dry for about 12 hours at room temperature and humidity, and then was heat treated at 120° C. for 30 minutes.

Comparative Example 1

For comparison purposes a commercially available photoreceptor (XEROX® Nuvera® production photoreceptor) was used as a benchmark reference device.

Test Results

Time of Flight Measurements

Time-of-flight photocurrent transient measurements of the respective samples were measured under the above mentioned conditions, using example devices 1 to 14 and comparative example 1. Photocurrent transients were measured for transport from the substrate to the surface as well as for transport from the surface to the substrate side of the charge transport layer. For the time-of-flight measurements of surface-to-substrate transport for the example devices, 8 to 14 and comparative example 1, in which charge was generated in a separate charge generation layer neighboring the charge transport layer, an additional charge generation layer was coated on top of the charge transport layer, as shown in FIG. 2B. This additional charge generation layer was prepared and deposited on the charge transport layer in accordance with the following procedure. A charge generation layer mill base was prepared by introducing into a 120 mL amber glass bottle 2.4 g hydroxygallium phthalocyanine, 0.45 g PCZ-200® (Mitsubishi Gas Chemical, Inc.), 44.65 g tetrahydrofuran, 60 mL of ⅛ inch stainless steel shot, mill mixture in amble bottle on a rolling mill for 8 hours at 125 RPM. Introduce into a 30 mL amber glass bottle 0.41 g PCZ-200® (Mitsubishi Gas Chemical, Inc.), 6.43 g tetrahydrofuran, 10 mg of charge generation layer mill base. Mill mixture in amber bottle on a rolling mill for 15 minutes at 125 RPM. This mixture was then blade-coated by hand onto a the charge transport layer of example devices 8 to 14 an comparative example 1 to form a charge transport layer coating that upon drying had a thickness of about 0.5 micron. The cast film was allowed to dry for more than 1 hour at room temperature and humidity, and then was heat treated at 120° C. for 15 minutes.

Time-of-flight sample cells were assembled for the time-of-flight measurements as mentioned above. That is to say that a top electrode (e.g., a semi-transparent metalized support substrate) was applied by pressure contact onto the surface of the sample, as shown in FIGS. 1 and 2. Pressure between the top electrode and the sample was applied with use of a compressing apparatus with a transparent window, 1 MPa pressure was applied to create an intimate contact between the top electrode and the sample surface. Time-of-flight measurements were performed at a applied electric field of 10 V/μm. For examples 1 to 7 charge was generated directly in the charge transport layer via a 10 ns, 337 nm wavelength light pulse, and for examples 8 to 14 and comparative example 1 charge was generated in a separate charge generation layer neighboring the charge transport layer via a 10 ns, 650 nm wavelength light pulse.

The respective time-of-flight photocurrent transients for examples 1 to 14 and comparative example 1 are shown in FIG. 3A to 3G, and FIG. 5A to 5H. Both the slopes of the plateau region for the substrate to surface transport transient and surface to substrate transport transient for each sample was analyzed as shown in FIG. 4. Then the difference 'δ' between the slopes was calculated by equation (1). Results of the slope analysis and 'δ' calculation are shown in Table 1 and Table 2. These results clearly indicate that a CTM gradient can be formed through the thickness of the CTL, such that there is a greater concentration of CTM at the substrate side of the CTL as compared to the surface side of the CTL, and that the magnitude of the CTM gradient varies with the different formulations of examples 1 to 14 as well as comparative example 1.

Comparison of PIDC Properties

Electrical and photodischarge characteristics were evaluated in a xerographic electrical properties scanning instrument to obtain photoinduced discharge cycles, sequenced at one charge-expose-erase cycle, wherein the light intensity was incrementally increased after each cycle to produce a series of photoinduced discharge characteristic curves (PIDC) from which the photosensitivity and surface potentials at various exposure intensities were measured. The scanner was equipped with a scorotron set to a constant voltage charging at various surface potentials. The photoconductors were tested at surface potentials of −500 volts with the exposure light intensity incrementally increased by regulating a series of neutral density filters; the exposure light source was a 780 nm xenon lamp. The discharge potentials at the various exposure intensities were measured 117 ms after exposure. The xerographic simulation was conducted in an environmentally controlled light tight chamber at 40% relative humidity and 22° C.

PIDC measurements were performed on the example devices 8-14, as well as comparative example 1, and the results of the measurements are summarized in Table 3, where, Vo is the photoreceptor surface voltage 336 ms after scorotron charging, V1 is the voltage 117 ms after exposure to 1 Erg/cm$^2$, V3 is the voltage 117 ms after exposure to 3 Ergs/cm$^2$, and Vr is the residual voltage, which is the average discharge 117 ms after exposures above 10 Ergs/cm$^2$. The results show a fairly subtle difference between the inventive devices of Example 8-14 and comparative Example 1. This indicates that the electric properties of the devices are not significantly affected by the presence of a gradient in the charge transport layer. Thus, in terms of electrical properties, these results suggest that the inventive device has similar electrical discharge properties as the comparative Example 1.

TABLE 3

| Name | Vo (v) | V1 (v) | V3 (v) | Vr (v) |
|---|---|---|---|---|
| Example 8 | 462 | 254 | 74 | 24 |
| Example 9 | 490 | 203 | 49 | 26 |
| Example 10 | 479 | 166 | 43 | 22 |
| Example 11 | 471 | 167 | 42 | 23 |
| Example 12 | 486 | 166 | 46 | 26 |
| Example 13 | 484 | 141 | 42 | 25 |
| Example 14 | 490 | 167 | 59 | 41 |
| Comparative Example 1 | 487 | 162 | 44 | 23 |

Deletion Resistance

Lateral Charge Migration (LCM) resistance was evaluated by a lateral charge migration (LCM) print testing scheme. The above prepared hand coated imaging member examples 8-14 and comparative example 1 were cut into 6"×1" strips. One end of each strip from the respective devices was cleaned using a solvent to expose the metallic conductive layer on the substrate. The conductivity of the exposed metallic Ti—Zr conductive layer was then measured to ensure that the metal had not been removed during cleaning. The conductivity of the exposed metallic Ti—Zr conductive layer was measured using a multimeter to measure the resistance across the exposed metal layer (around 1 KOhm). A 60 mm DC252 Xerox® standard photoreceptor drum was then prepared to expose a strip around the drum to provide the ground for the handcoated device when it was operated. The cleaning blade was removed from the drum housing to prevent it from removing the hand coated devices during operation. The imaging members from the Examples were then mounted onto the photoreceptor drum using conductive copper tape to adhere the exposed conductive end of the devices to the exposed aluminum on the drum to complete a conductive path to the ground. After mounting the devices, the device-to-drum conductivity was measured using a standard multimeter in a resistance mode. The resistance between the respective devices and the drum was expected to be similar to the resistance of the conductive coating on the respective hand coated devices. The ends of the devices were then secured to the drum using 3M Scotch® tape, and all exposed conductive surfaces were covered with Scotch® tape. The drum was then placed in a DocuColor 252 Xerox® (DC252) machine and a template containing 1 bit, 2 bit, 3 bit, 4 bit, and 5 bit lines was printed. The machine settings (developer bias, laser power, grid bias) were adjusted to obtain a visible print that resolved the 5 individual lines above. If the 1 bit line was barely showing, then the settings were saved and the print became the reference, or the pre-exposure print. The drum was removed and placed in a charge-discharge apparatus that generated corona discharge during operation. The drum was charged and discharged (cycled) for 25,000 cycles to induce deletion (LCM). The drum was then removed from the apparatus and placed in the DC252 machine and the template was printed again.

Figure 7:
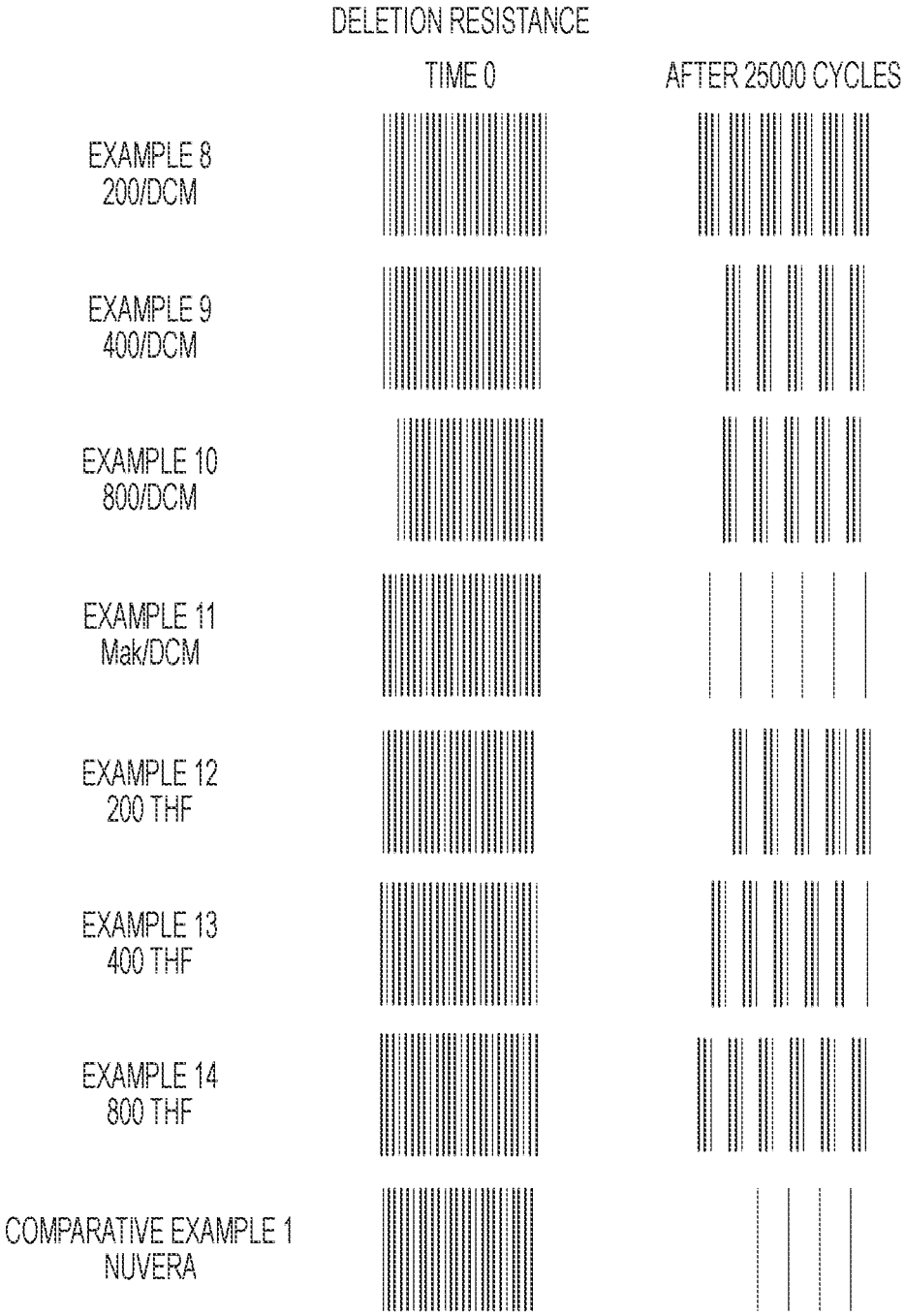
FIG. 7 provides the results of scorotron deletion print tests performed on comparative and sample devices with the charge transport layer formulated according to the present embodiments.

Scorotron deletion print tests were performed on examples 8-14 as well as comparative example 1. The results are shown in FIG. 7, they indicate that the inventive device of Examples 10, 13, and 14 demonstrated considerably greater deletion resistance than comparative example 1.

Improved Wear/Cracking Resistance

It is surmised that, due to the low concentration of TPD near the surface side of the charge transport layer, the cracking and wear resistance of the inventive device of Example 10, 13, and 14 would be enhanced.

It is further noted that the method of adjusting binder molecular weight and solvent type to achieve a concentration gradient in the charge transport layer for improved deletion and mechanical properties would be applicable to drum coatings as well.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method of measuring a charge transport molecule gradient in a charge transport layer comprising:

measuring a photocurrent transient of charge transport from a substrate-to-surface side of the charge transport layer by time-of-flight measurement;

measuring a photocurrent transient of charge transport from a surface-to-substrate side of the charge transport layer in a direction opposite to the photocurrent transient previously measured by time-of-flight measurement;

calculating a difference δ of the photocurrent transients to determine a gradient of a charge transport material gradient based on $$\delta=\alpha-\beta$$

wherein α is a slope of the plateau region of the substrate-to-surface transient, and β is a slope of the plateau region of the surface-to-substrate transient.

2. The method of claim 1, wherein difference δ indicates a magnitude of the charge transport molecule gradient through the thickness of the charge transport layer.

3. The method of claim 1, wherein a negative value of difference δ indicates that there is a decreasing charge transport molecule gradient through the thickness of the charge transport layer from the substrate-to-surface side of the charge transport layer.

4. The method of claim 1, wherein a positive value of difference δ indicates that there is an increasing charge transport molecule gradient through the thickness of the charge transport layer from the substrate-to-surface side of the charge transport layer.

5. The method of claim 1, wherein the difference between the slope α and slope β is alternately calculated based on $\delta'=\beta-\alpha$, wherein α is a slope of the plateau region of the substrate-to-surface transient, and β is a slope of the plateau region of the surface-to-substrate transient.

6. The method of claim 5, wherein difference δ' indicates a magnitude of the charge transport molecule gradient through the thickness of the charge transport layer.

7. The method of claim 5, wherein a positive value of difference δ' indicates that there is a decreasing charge transport molecule gradient through the thickness of the charge transport layer from the substrate-to-surface side of the charge transport layer.

8. The method of claim 5, wherein a negative value of difference δ' indicates that there is an increasing charge transport molecule gradient through the thickness of the charge transport layer from the substrate-to-surface side of the charge transport layer.

9. The method of claim 1, wherein the step of measuring the photocurrent transients further comprises generating free charge in the charge transport layer.

10. The method of claim 9, wherein the charge is generated via an ultraviolet light.

11. The method of claim 1, wherein the step of measuring the photocurrent transients further comprises generating a charge in a layer adjacent to the charge transport layer.

12. The method of claim 11, wherein the charge is generated via infrared light.

13. A method of measuring a charge transport molecule gradient in a charge transport layer comprising:

providing a sample cell for time-of-flight measurements comprising
a support substrate,
a first electrode,
a charge transport layer,
a second electrode, and
a top substrate;

measuring a photocurrent transient of charge transport from a substrate-to-surface side of the charge transport layer by time-of-flight measurement;

measuring a photocurrent transient of charge transport from a surface-to-substrate side of the charge transport layer in a direction opposite to the photocurrent transient previously measured by time-of-flight measurement;

calculating a difference δ of the photocurrent transients to determine a gradient of a charge transport material gradient based on $$\delta=\alpha-\beta$$

wherein α is a slope of the plateau region of the substrate-to-surface transient, and β is a slope of the plateau region of the surface-to-substrate transient.

14. The method of claim 13, wherein the support substrate further comprises a layer of silane disposed on the support substrate.

15. The method of claim 13, wherein the step of measuring the photocurrent transients of charge transport from a substrate-to-surface side of the charge transport layer further comprises generating a charge at a substrate side of the charge transport layer.

16. The method of claim 13, wherein the step of measuring the photocurrent transients of charge transport from a surface-to-substrate side of the charge transport layer further comprises generating a charge at a surface side of the charge transport layer.

17. A method of measuring a charge transport molecule gradient in a charge transport layer comprising:

providing a sample cell for time-of-flight measurements comprising
a support substrate,
a first electrode,
a charge transport layer,
a second electrode, and
a top substrate, wherein a charge generation layer is disposed either between the first electrode and charge transport layer or between the charge transport layer and the second electrode;

measuring photocurrent transients of charge transport from a substrate-to-surface side of the charge transport layer by time-of-flight measurement;

measuring photocurrent transients of charge transport from a surface-to-substrate side of the charge transport layer in a direction opposite to the photocurrent transient previously measured by time-of-flight measurement calculating a difference δ of the photocurrent transients to determine a gradient of a charge transport material gradient based on $$\delta=\alpha-\beta$$

wherein α is a slope of the plateau region of the substrate-to-surface transient, and β is a slope of the plateau region of the surface-to-substrate transient.

18. The method of claim 17, wherein a charge generation layer is disposed both between the first electrode and charge transport layer and between the charge transport layer and the second electrode.

19. The method of claim 17, wherein the step of measuring the photocurrent transients of charge transport from a substrate-to-surface side of the charge transport layer further comprises generating a charge at a substrate side of the charge generation layer.

20. The method of claim 17, wherein the step of measuring the photocurrent transients of charge transport from a surface-to-substrate side of the charge transport layer further comprises generating a charge at a surface side of the charge generation layer.

* * * * *